US010059118B2

(12) United States Patent
Sato et al.

(10) Patent No.: US 10,059,118 B2
(45) Date of Patent: Aug. 28, 2018

(54) LIQUID EJECTING UNIT, DRIVING METHOD THEREOF, AND LIQUID EJECTING APPARATUS

(71) Applicant: SEIKO EPSON CORPORATION, Tokyo (JP)

(72) Inventors: Masahiko Sato, Matsumoto (JP); Ryoji Fujimori, Suwa (JP); Kaoru Koike, Matsumoto (JP); Shigenori Nakagawa, Tatsuno (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/421,078

(22) Filed: Jan. 31, 2017

(65) Prior Publication Data

US 2017/0217176 A1 Aug. 3, 2017

(30) Foreign Application Priority Data

Feb. 2, 2016 (JP) ..... 2016-017936
May 9, 2016 (JP) ..... 2016-094100
Sep. 1, 2016 (JP) ..... 2016-170967

(51) Int. Cl.
*B41J 2/18* (2006.01)
*B41J 2/175* (2006.01)
*B41J 2/045* (2006.01)
*B41J 2/14* (2006.01)

(52) U.S. Cl.
CPC ..... *B41J 2/18* (2013.01); *B41J 2/04581* (2013.01); *B41J 2/14201* (2013.01); *B41J 2/175* (2013.01); *B41J 2/17556* (2013.01)

(58) Field of Classification Search
CPC ..... B41J 2/14201; B41J 2/18; B41J 2/17556; B41J 2/04581; B41J 2/175
See application file for complete search history.

(56) References Cited

U.S. PATENT DOCUMENTS 7,104,640 B2 9/2006 Ogura et al.
7,556,362 B2 7/2009 Akahane
2008/0043077 A1 2/2008 Hong
2008/0151026 A1 6/2008 Kobayashi
2008/0198207 A1* 8/2008 Katada ..... B41J 2/175 347/85
2008/0297545 A1 12/2008 Umeda
(Continued)

FOREIGN PATENT DOCUMENTS

EP 2 574 471 A1 4/2013
EP 2 891 558 A1 7/2015
(Continued)

OTHER PUBLICATIONS

European Search Report for Application No. 17154273.1 dated Jul. 4, 2017.

*Primary Examiner* — Geoffrey Mruk
(74) *Attorney, Agent, or Firm* — Workman Nydegger

(57) ABSTRACT

There is provided an ejecting unit for ejecting a first fluid from nozzles, including: a first connection port to flow the first fluid; a second connection port to flow a second fluid; a driving portion configured to eject the first fluid in a flow path which communicates with the first connection port and the nozzles, from the nozzles; a first chamber that communicates with the second connection port; and a second chamber that communicates with the second connection port.

13 Claims, 21 Drawing Sheets

(56) References Cited

U.S. PATENT DOCUMENTS

| | | | |
|---|---|---|---|
| 2008/0297579 | A1 | 12/2008 | Umeda |
| 2010/0201765 | A1 | 8/2010 | Paku et al. |
| 2012/0127242 | A1 | 5/2012 | Koike et al. |
| 2015/0273851 | A1 | 10/2015 | Akahane et al. |

FOREIGN PATENT DOCUMENTS

| | | |
|---|---|---|
| JP | 2002-144576 | 5/2002 |
| JP | 2006-027012 | 2/2006 |
| JP | 2009-006695 | 1/2009 |
| JP | 2009-006696 | 1/2009 |
| JP | 2010-201925 | 9/2010 |
| JP | 2012-028448 | 2/2012 |
| JP | 2012-066470 | 4/2012 |
| JP | 2012-111044 | 6/2012 |
| JP | 2013 032023 A | 2/2013 |
| JP | 2013 071247 A | 4/2013 |
| JP | 2015-189201 | 11/2015 |

* cited by examiner

<CLOSED STATE>

<OPENED STATE>

LIQUID EJECTING UNIT, DRIVING METHOD THEREOF, AND LIQUID EJECTING APPARATUS

The entire disclosure of Japanese Patent Application No.: 2016-094100, filed May 9, 2016; Japanese Patent Application No.: 2016-017936, filed Feb. 2, 2016 and Japanese Patent Application No.: 2016-170967, filed Sep. 1, 2016 are expressly incorporated by reference herein.

BACKGROUND

1. Technical Field

The present invention relates to a liquid ejecting unit that ejects liquid from nozzles, a driving method of the liquid ejecting unit, and a liquid ejecting apparatus including the liquid ejecting unit.

2. Related Art

A liquid ejecting unit ejects liquid such as ink or the like that is supplied from a liquid storage unit such as an ink tank or the like from a plurality of nozzles by the pressure change of a pressure generating unit, as a droplet. In the related art, a configuration in which a pressure adjustment valve that is opened by the pressure of the flow path at the downstream side in the middle being a negative pressure is provided such that the liquid such as ink or the like supplied from the liquid storage unit is supplied to the liquid ejecting unit at a predetermined pressure, has been proposed (for example, refer to JP-A-2012-111044).

In JP-A-2012-111044, a configuration in which a pressing mechanism that opens a valve by pressing the valve from the outside regardless of the pressure of the flow path at the downstream side is provided is disclosed.

In addition, a configuration in which a fluid such as air or the like is pressurized and supplied and thus a valve is opened by pressing a pressure adjustment valve using the pressurized fluid is disclosed (for example, refer to JP-A-2015-189201).

However, when many connection ports for pressurization and depressurization are provided in addition to the connection port for supplying liquid, the number of joints increases, and thus there is a problem that attachment and detachment of the liquid ejecting unit becomes complicated.

SUMMARY

An advantage of some aspects of the invention is to provide a liquid ejecting unit that can be easily attached and detached by reducing the number of joints when attaching and detaching, a driving method of the liquid ejecting unit, and a liquid ejecting apparatus including the liquid ejecting unit.

According to an aspect of the invention, there is provided a ejecting unit for ejecting a first fluid from nozzles, including: a first connection port to flow the first fluid; a second connection port to flow a second fluid; a driving portion configured to eject the first fluid in a flow path which communicates with the first connection port and the nozzles, from the nozzles; first chamber that communicates with the second connection port; and a second chamber that communicates with the second connection port.

According to this aspect, it is possible to easily attach and detach the ejecting unit by reducing the number of the connection ports to which the first fluid used for ejection and the second fluid used for pressurization and depressurization are supplied. In addition, it is possible to realize a high-performance ejecting unit by pressurizing and depressurizing the inside of the ejecting unit, if the first chamber is pressurized via the second connection port and the second chamber is depressurized via the second connection port.

In the ejecting unit, preferably, the first chamber is configured to change the volume of the flow path, and the second chamber is configured to store an air in the flow path. According to this aspect, it is possible to realize a high-performance flow path by changing the volume using pressurization. Further, it is possible to suck and remove the air bubble by depressurization.

Preferably, the ejecting unit further includes a film that is biased to the first chamber by pressurization to the first chamber, and a buffer chamber that is provided between the first chamber and the film and does not communicate with the first chamber and the second chamber in the ejecting unit. According to this aspect, even when the first chamber is depressurized due to the depressurization of the second chamber, the buffer chamber is provided, and thus it is possible to suppress an influence on the film.

In the ejecting unit, preferably, the buffer chamber is opened to the atmosphere. According to this aspect, it is possible to suppress an influence on the film with the buffer chamber being opened to the atmosphere with a simple configuration, and thus the cost can be reduced.

In the ejecting unit, preferably, a portion at which the first chamber and the film are in contact with each other is roughened. According to this aspect, it is possible to prevent the movable film and the wall surface of the first chamber from sticking together by condensation or the like. At least one of the first chamber and the movable film may be roughened.

Preferably, the ejecting unit further includes a gas-permeable film that is disposed between the second chamber and the flow path, and a zigzag path that applies diffusion resistance between the second chamber and the second connection port. Preferably, the air in the flow path is moved to the inside of the second chamber by depressurizing the inside of the second chamber. According to this aspect, even when the moisture of the liquid is evaporated via the gas-permeable film, diffusion resistance is applied by the zigzag path, and thus it is possible to suppress the evaporation of the moisture of the liquid. Further, since the zigzag path is provided between the second connection port and the second chamber, it is possible to use a low-pressure pump for depressurization compared to a case where the zigzag path is provided at all portions of the second connection port and the second chamber, and it is possible to shorten the operating time of the pump.

Preferably, the ejecting unit further includes a gas-permeable film that is provided between the second chamber and the flow path, and a depressurization maintaining unit in communication with the second connection port. According to this aspect, it is possible to perform degassing by the gas-permeable film, and maintain the depressurization state of the degassing space by the depressurization maintaining unit. If a bidirectional valve is provided at the outside of the second connection port, then it is possible to reduce the size of the liquid ejecting unit.

Preferably, the ejecting unit further includes a one-way valve that is provided between the second chamber and the second connection port so as to allow the flow from the second chamber to the second connection port. According to this aspect, the one-way valve is provided, and thus it is possible to effectively pressurize the first chamber by preventing the second chamber from pressurizing when the first chamber is pressurized.

Preferably, the ejecting unit further includes at least one regulating portion that regulates the expansion and the contraction of the volume of the second chamber. According to this aspect, it is possible to suppress the expansion of the second chamber when the first chamber is pressurized. In addition, it is possible to suppress the contraction of the second chamber when the second chamber is depressurized. Therefore, it is possible to suppress the damage of the member, for example, the gas-permeable film or the like that constitutes the wall surface of the second chamber. One of the plurality of the regulating portions may regulate the expansion of the volume of the second chamber, and the other may regulate the contraction of the volume of the second chamber.

Preferably, the ejecting unit further includes a regulating portion that regulates the contraction of the volume of the first chamber. According to this aspect, it is possible to suppress the damage of the member that constitutes the wall surface of the first chamber by contracting the volume of the first chamber.

In the ejecting unit, preferably, at least a portion of the first chamber and at least a portion of the second chamber are formed by a different member. According to this aspect, it possible to realize the respective functions of the first chamber and the second chamber.

In the liquid ejecting unit, preferably, any one of the first chamber and the second chamber is adjacent to the flow path of the first fluid, and the other of the first chamber and the second chamber is not adjacent to the flow path of the first fluid. According to this aspect, it possible to realize the respective functions of the first chamber and the second chamber easily.

According to another aspect of the invention, there is provided an ejecting apparatus, including: the ejecting unit according to the aspect; and a pressure adjuster configured to pressurize the first chamber via the second connection port and depressurize the second chamber via the second connection port.

According to this aspect, it is possible to easily attach and detach the ejecting unit by reducing the number of the connection ports to which the first fluid used for ejection and the second fluid used for pressurization and depressurization are supplied. In addition, it is possible to realize a high-performance ejecting unit by pressurizing and depressurizing the inside of the ejecting unit, if the first chamber is pressurized via the second connection port and the second chamber is depressurized via the second connection port.

According to still another aspect of the invention, there is provided a driving method of a ejecting unit, the ejecting unit including: a first connection port to flow a first fluid, a second connection port to flow a second fluid, a driving portion configured to eject the first fluid in a flow path which communicates with the first connection port from nozzles, a first chamber that communicates with the second connection port, and a second chamber that communicates with the second connection port, the method including: pressurizing the first chamber from the second connection port; and depressurizing the second chamber from the second connection port.

According to this aspect, it is possible to realize a high-performance ejecting unit by pressurizing and depressurizing the inside of the liquid ejecting unit.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
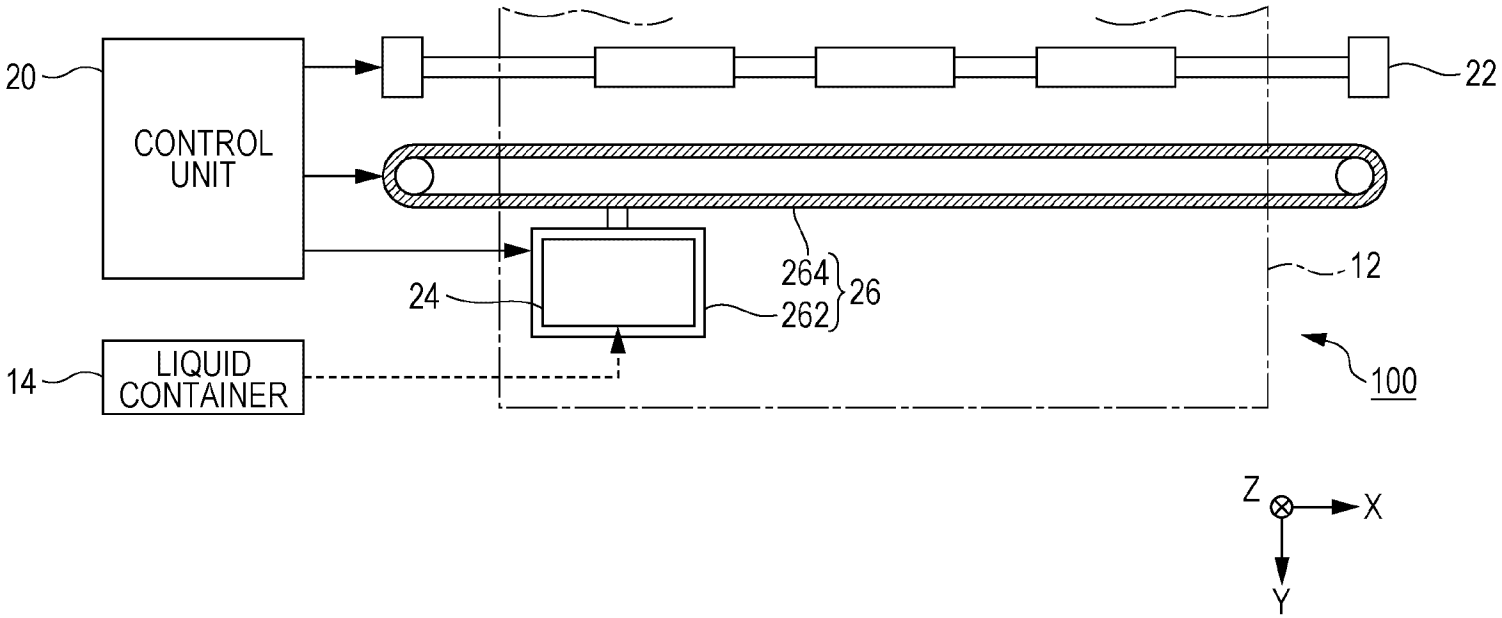
FIG. 1 is a configuration diagram of a liquid ejecting apparatus according to a first embodiment of the invention.

FIG. 1 is a configuration diagram of a liquid ejecting apparatus 100 according to a first embodiment of the invention. The liquid ejecting apparatus 100 according to the first embodiment is an ink jet type printing apparatus that ejects ink as an example of liquid onto a medium 12. The medium 12 is typically printing paper, but any printing object such as a resin film and a fabric may be used as the medium 12. A liquid container 14 that stores ink is fixed to the liquid ejecting apparatus 100. For example, a cartridge that can be attached and detached to and from the liquid ejecting apparatus 100, a bag-shaped ink pack that is formed by a flexible film, or an ink tank that can supplement ink is used as the liquid container 14. A plurality of types of ink with different colors are stored in the liquid container 14.

As illustrated in FIG. 1, the liquid ejecting apparatus 100 includes a control unit 20, a transport mechanism 22, and a liquid ejecting head 24. The control unit 20 is configured to include, for example, a control device such as a central processing unit (CPU), a field programmable gate array (FPGA), or the like and a memory device such as a semiconductor memory (not illustrated), and overall controls each element of the liquid ejecting apparatus 100 by executing a program stored in the memory device by the control device. The transport mechanism 22 transports the medium 12 to a Y-direction under the control of the control unit 20.

The liquid ejecting apparatus 100 according to the first embodiment includes a movement mechanism 26. The movement mechanism 26 is a mechanism that reciprocates the liquid ejecting head 24 to an X-direction under the control by the control unit 20. The X-direction in which the liquid ejecting head 24 is reciprocated is a direction that intersects (typically is orthogonal to) the Y-direction in which the medium 12 is transported. The movement mechanism 26 according to the first embodiment includes a transport body 262 and a transport belt 264. The transport body 262 is a substantially box-shaped structure (carriage) that supports the liquid ejecting head 24, and fixed to the transport belt 264. The transport belt 264 is an endless belt that is placed along the X-direction. The transport belt 264 is rotated under the control of the control unit 20, and thus the liquid ejecting head 24 is reciprocated along the X-direction together with the transport body 262. The liquid container 14 may be mounted to the transport body 262 together with the liquid ejecting head 24.

The liquid ejecting head 24 ejects the ink supplied from the liquid container 14 onto the medium 12 under the control of the control unit 20. The liquid ejecting head 24 ejects the ink onto the medium 12 during a period for which the transport of the medium 12 by the transport mechanism 22 and the transport of the liquid ejecting head 24 by the movement mechanism 26 are executed, and thus a desired image is formed on the medium 12. In the following description, a direction perpendicular to an X-Y plane is referred to as a Z-direction. The ink ejected from the liquid ejecting head 24 proceeds to the positive side of the Z-direction and is landed on the surface of the medium 12.

Figure 2:
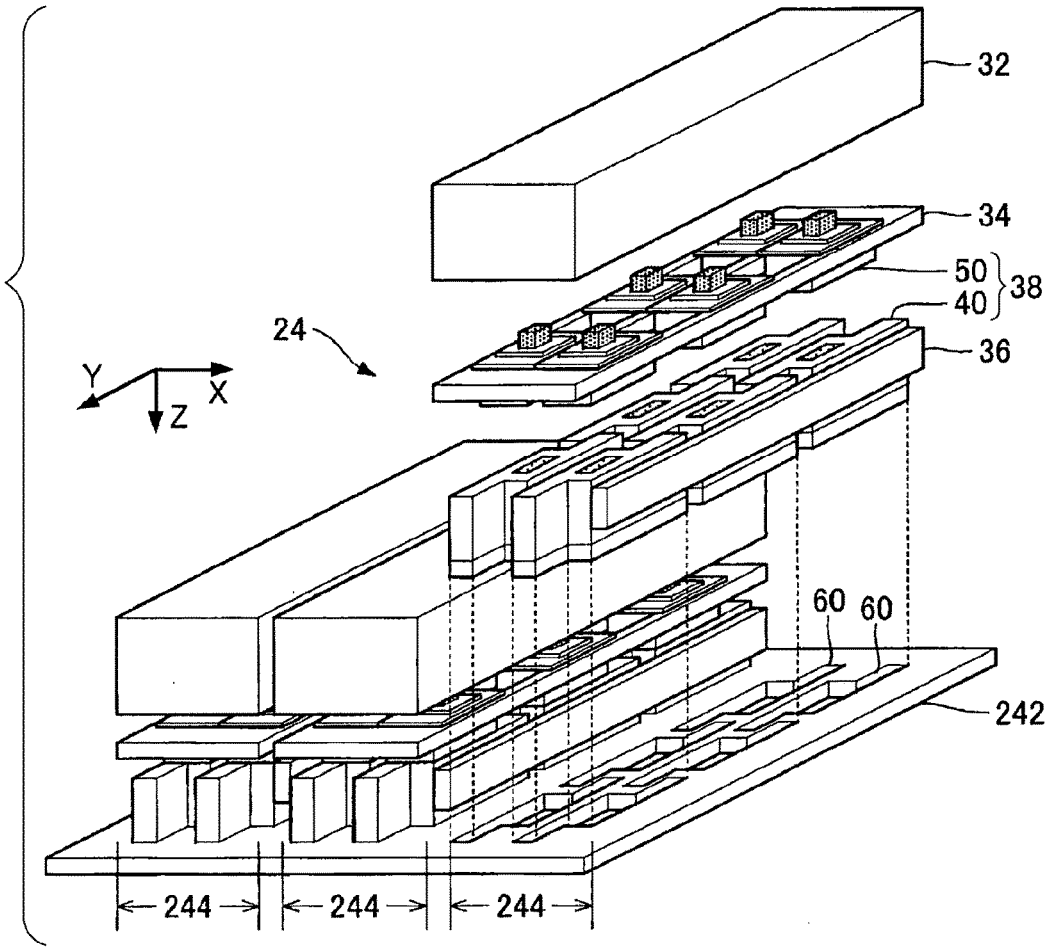
FIG. 2 is an exploded perspective view of a liquid ejecting head.

FIG. 2 is an exploded perspective view of the liquid ejecting head 24. As illustrated in FIG. 2, the liquid ejecting head 24 according to the first embodiment includes a first support body 242 and a plurality of assemblies 244. The first support body 242 is a plate-shaped member that supports the plurality of assemblies 244 (liquid ejecting head support body). The plurality of assemblies 244 are fixed to the first support body 242 in a state of being arranged in the X-direction. As typically illustrated for one of the assemblies 244, each of the plurality of assemblies 244 includes a connection unit 32, a second support body 34, a distribution flow path 36, a plurality of (in the first embodiment, six) liquid ejecting modules 38. The total number of the assemblies 244 that constitute the liquid ejecting head 24 and the total number of the liquid ejecting modules 38 that constitute the assembly 244 are not limited to the example illustrated in FIG. 2.

Figure 3:
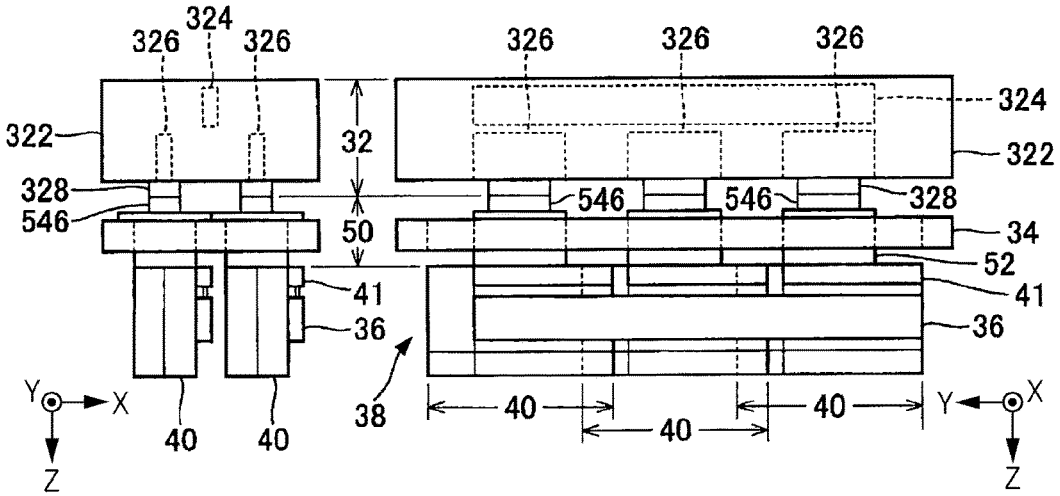
FIG. 3 is a side view of an assembly.

FIG. 3 is a front view and a side view of any one assembly 244. As seen from FIGS. 2 and 3, schematically, the plurality of liquid ejecting modules 38 are disposed in two rows at the second support body 34 that is positioned directly below the connection unit 32, and the distribution flow path 36 is disposed at the side of the plurality of liquid ejecting modules 38. The distribution flow path 36 is a structure in which a flow path for distributing the ink supplied from the liquid container 14 to each of the plurality of liquid ejecting modules 38 is formed, and is configured to elongate in the Y-direction so as to across the plurality of liquid ejecting modules 38.

As illustrated in FIG. 3, the connection unit 32 includes a housing 322, a relay substrate 324, and a plurality of driving substrates 326. The housing 322 is a substantially box-shaped structure that accommodates the relay substrate 324 and the plurality of driving substrates 326. Each of the plurality of driving substrates 326 is a wiring substrate corresponding to each of the liquid ejecting modules 38. A signal generating circuit that generates a driving signal having a predetermined waveform is mounted on the driving substrate 326. A control signal for specifying the presence or absence of the ejection of the ink for each nozzle and a power supply voltage are supplied from the driving substrate 326 to the liquid ejecting module 38 together with the driving signal. An amplifier circuit that amplifies the driving signal may be mounted to the driving substrate 326. The relay substrate 324 is a wiring substrate that relays an electrical signal and the power supply voltage between the control unit 20 and the plurality of driving substrates 326, and is commonly used across the plurality of liquid ejecting modules 38. As illustrated in FIG. 3, a connection portion 328 that is electrically connected to each of the driving substrates 326 (an example of a second connection portion) is provided at the bottom surface of the housing 322. The connection portion 328 is a connector for electrical connection (board-to-board connector).

Figure 4:
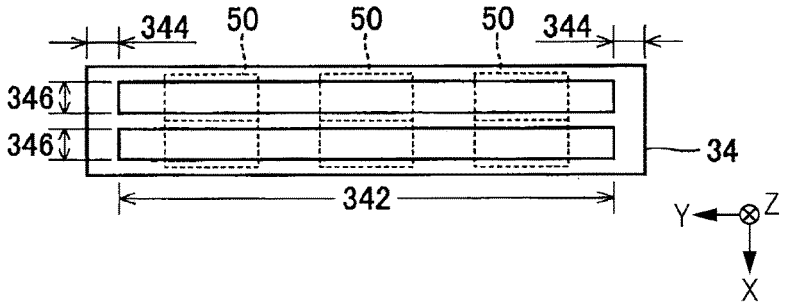
FIG. 4 is a plan view of a second support body.

FIG. 4 is a plan view of the second support body 34. As illustrated in FIGS. 3 and 4, the second support body 34 is a structure (frame) that elongates in the Y-direction, and includes a plurality of (in the example illustrated in FIG. 4, three) support portions 342 that extend in the Y-direction at a distance therebetween in the X-direction, and coupling portions 344 that couple the ends of each of the support portions 342 with each other. In other words, the second support body 34 is a flat plate member in which two opening portions 346 that elongate in the Y-direction are formed at a distance in the X-direction. Each of the coupling portions 344 of the second support body 34 is fixed to the first support body 242 at the position at a distance from the surface of the first support body 242.

Figure 5:
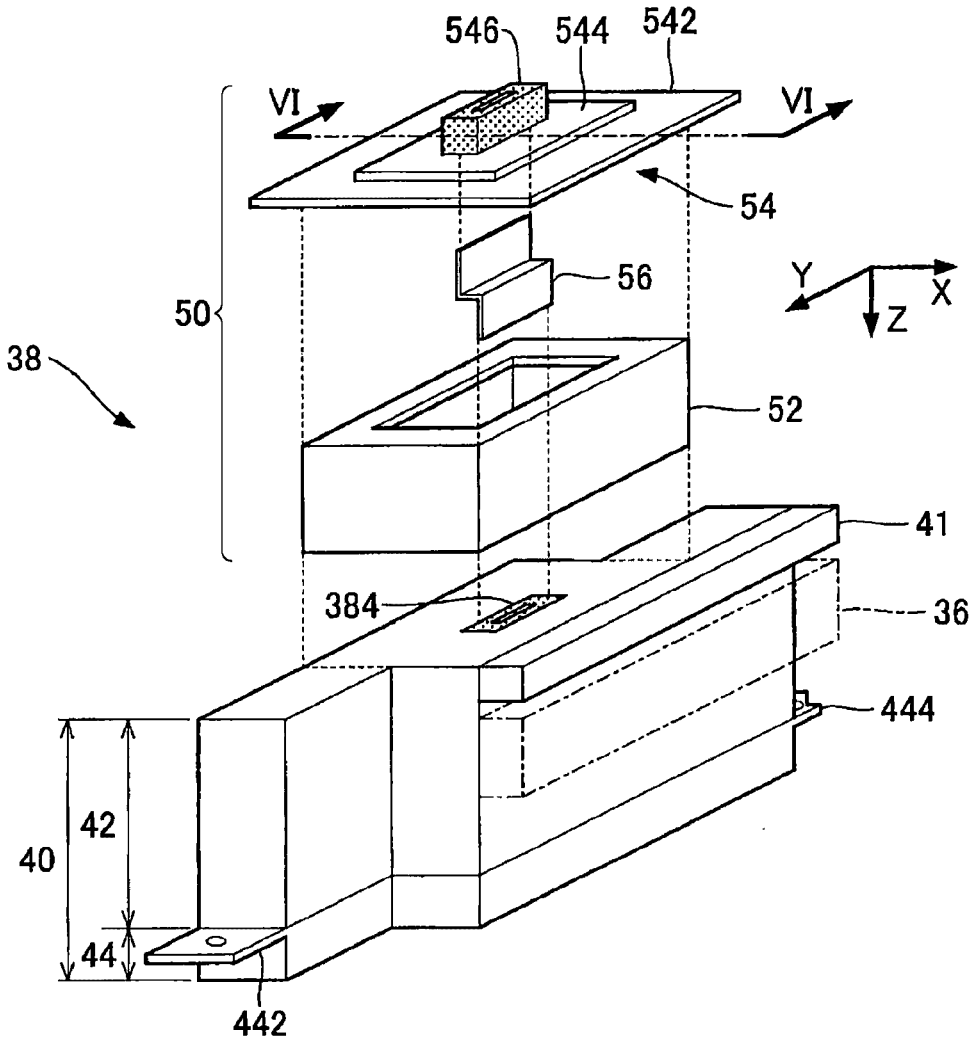
FIG. 5 is an exploded perspective view of a liquid ejecting module.

FIG. 5 is an exploded perspective view of any one liquid ejecting module 38. As illustrated in FIG. 5, the liquid ejecting module 38 according to the first embodiment includes a liquid ejecting unit 40, a coupling unit 50, and a transmission line 56. The liquid ejecting unit 40 ejects the ink supplied from the liquid container 14 via the distribution flow path 36, onto the medium 12. The liquid ejecting unit 40 according to the first embodiment includes a valve mechanism unit 41, a flow path unit 42, and a liquid ejecting portion 44. The valve mechanism unit 41 includes a valve mechanism that controls the opening/closing of the flow path of the ink supplied from the distribution flow path 36.

For convenience, the valve mechanism unit 41 is not illustrated in FIG. 2. As illustrated in FIG. 5, the valve mechanism unit 41 according to the first embodiment is provided so as to protrude from the side surface of the liquid ejecting unit 40 in the X-direction. On the other hand, the distribution flow path 36 is provided on the first support body 242 so as to be opposite to the side surface of the liquid ejecting unit 40. Therefore, the top surface of the distribution flow path 36 and the bottom surface of each valve mechanism unit 41 are opposite to each other at a distance therebetween in the Z-direction. In the above configuration, the flow path in the distribution flow path 36 and the flow path in the valve mechanism unit 41 communicate with each other.

The liquid ejecting portion 44 of the liquid ejecting unit 40 ejects the ink from a plurality of nozzles. The flow path unit 42 is a structure in which the flow path for supplying the ink passed through the valve mechanism unit 41 to the liquid ejecting portion 44 is formed therein. On the top surface of the liquid ejecting unit 40 (specifically, the top surface of the flow path unit 42), a connection portion 384 that electrically connects the liquid ejecting unit 40 to the driving substrate 326 of the connection unit 32 is provided. The coupling unit 50 is a structure that connects the liquid ejecting unit 40 to the second support body 34. The transmission line 56 illustrated in FIG. 5 is, for example, a flexible cable such as a flexible flat cable (FFC), flexible printed circuits (FPC), or the like.

Figure 6:
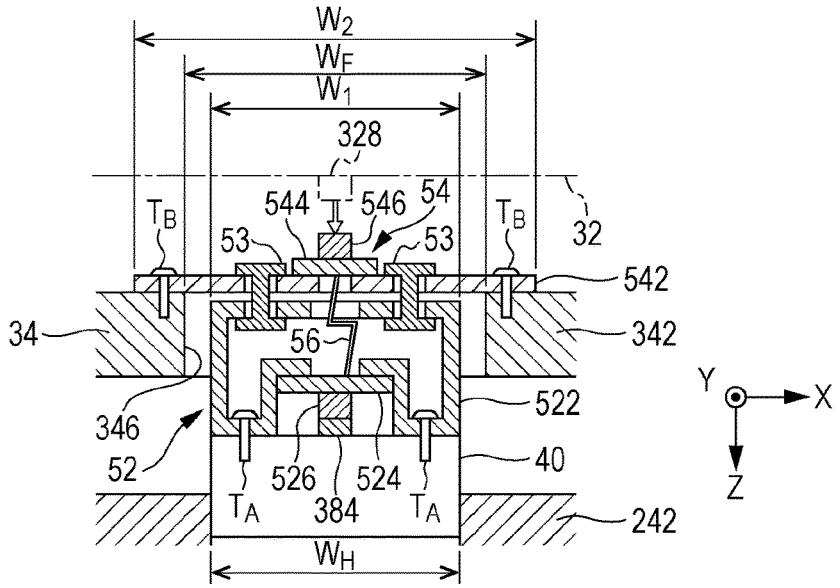
FIG. 6 is a sectional view of the liquid ejecting module (sectional view taken along line VI-VI in FIG. 5).

FIG. 6 is a sectional view taken along line VI-VI in FIG. 5. As illustrated in FIGS. 5 and 6, the coupling unit 50 according to the first embodiment includes a first relay body 52 and a second relay body 54.

The first relay body 52 is a structure that is fixed to the liquid ejecting unit 40, and includes a housing body 522 and a wiring substrate 524 (an example of a second wiring substrate). The housing body 522 is a substantially box-shaped housing. As illustrated in FIG. 6, the liquid ejecting unit 40 is fixed to the bottom surface side of the housing body 522 (positive Z-direction) by fasteners $T_A$ such as, for example, a screw or the like. The wiring substrate 524 is a flat plate-shaped wiring substrate that constitutes the bottom surface of the housing body 522. A connection portion 526 (an example of a third connection portion) is provided on the surface of the wiring substrate 524 at the side of the liquid ejecting unit 40. The connection portion 526 is a connector for electrical connection (board-to-board connector). In a state where the first relay body 52 is fixed to the liquid ejecting unit 40, the connection portion 526 of the wiring substrate 524 is detachably coupled to the connection portion 384 of the liquid ejecting unit 40.

The second relay body 54 is a structure that fixes the liquid ejecting module 38 to the second support body 34 and electrically connects the liquid ejecting module 38 to the driving substrate 326, and includes a mounting substrate 542 and a wiring substrate 544 (an example of a first wiring substrate). The mounting substrate 542 is a plate-shaped member that is fixed to the second support body 34. As illustrated in FIG. 6, the housing body 522 of the first relay body 52 and the mounting substrate 542 of the second relay body 54 are coupled to each other by couplers 53. The coupler 53 is a pin in which both end portions of a cylindrical shaft body are molded in a flange shape, and is inserted into the through-holes that are formed at each of the first relay body 52 and the second relay body 54. The diameter of the shaft body of the coupler 53 is less than the internal diameter of the through-hole of each of the first relay body 52 and the second relay body 54. Therefore, a gap is formed between the outer peripheral surface of the shaft body of the coupler 53 and the inner peripheral surface of the through-hole, and the first relay body 52 and the second relay body 54 are coupled to each other in an unrestrained manner. In other words, one of the first relay body 52 and the second relay body 54 can be moved in the X-Y plane with respect to the other by the amount of the gap between the coupler 53 and the through-hole.

As illustrated in FIG. 6, the dimension $W_2$ in the X-direction of the second relay body 54 (the mounting substrate 542) is greater than the dimension $W_1$ in the X-direction of the first relay body 52 (the housing body 522). Therefore, the edge portions of the mounting substrate 542 that are positioned at the both sides in the X-direction protrude from the side surfaces of the first relay body 52 to the positive X-direction and the negative X-direction. The dimension $W_2$ of the second relay body 54 is greater than the dimension $W_F$ in the X-direction of the opening portion 346 of the second support body 34 ($W_2>W_F$). The portions of the mounting substrate 542 that protrude from the housing body 522 are fixed to the top surface of the support portion 342 in the second support body 34 by fasteners $T_B$ (in the example illustrated in FIG. 6, a plurality of screws). On the other hand, the dimension $W_1$ in the X-direction of the first relay body 52 is less than the dimension $W_F$ of the opening portion 346 of the second support body 34 ($W_1<W_F$). Therefore, as illustrated in FIG. 6, a gap is formed between the outer wall surface of the first relay body 52 (housing body 522) and the inner wall surface of the opening portion 346 of the second support body 34. In other words, in a state of the pre-installation of the first relay body 52 to the second support body 34, the first relay body 52 can pass through the opening portion 346 of the second support body 34. As can be understood from the above description, the second relay body 54 is fixed to the second support body 34, and the first relay body 52 is coupled to the second relay body 54 in an unrestrained manner. Thus, the second relay body 54 can move slightly in the X-Y plane with respect to the second support body 34.

The wiring substrate 544 is a plate-shaped member that is fixed to the surface of the mounting substrate 542 on the side opposite to the first relay body 52. A connection portion 546 (an example of a first connection portion) is provided on the surface of the wiring substrate 544 at the connection unit 32 side (negative Z-direction side). In other words, the connection portion 546 is fixed to the second support body 34 via the wiring substrate 544 and the mounting substrate 542. The connection portion 546 is a connector for electrical connection (board-to-board connector). Specifically, in a state where the second support body 34 is fixed to the connection unit 32, the connection portion 546 of the wiring substrate 544 is detachably coupled to the connection portion 328 of the connection unit 32. In other words, the connection portion 328 of the connection unit 32 can be attached and detached to and from the connection portion 546 from the side opposite to the liquid ejecting unit 40 (negative Z-direction side).

As illustrated in FIG. 6, the transmission line 56 is placed over the wiring substrate 544 and the wiring substrate 524, and electrically connects the connection portion 546 and the connection portion 526. As illustrated in FIGS. 5 and 6, the transmission line 56 is accommodated in the housing body 522 in a state of being bent along a straight line parallel to the X-direction between the connection portion 546 and connection portion 526. One end of the transmission line 56 is bonded to the surface of the wiring substrate 544 that is opposite to the wiring substrate 524, and electrically connected to the connection portion 546. The other end of the transmission line 56 is bonded to the surface of the wiring substrate 524 that is opposite to the wiring substrate 544, and electrically connected to the connection portion 526.

As can be understood from the above description, the driving substrate 326 of the connection unit 32 is electrically connected to the connection portion 384 of the liquid ejecting unit 40 via the connection portion 328, the connection portion 546, the wiring substrate 544, the transmission line 56, the wiring substrate 524, and the connection portion 526. Therefore, the electrical signal generated in the driving substrate 326 (driving signal, control signal) and the power supply voltage are supplied to the liquid ejecting unit 40 via the connection portion 328, the connection portion 546, the transmission line 56, and the connection portion 526.

However, for example, in a case where the position of each of the plurality of connection portions 546 is determined by the relative relationship between the connection portions 546 and the position of each of the plurality of liquid ejecting units 40 is determined by the relative relationship between the liquid ejecting units 40, there is a case where a position error between the connection portion 546 and the liquid ejecting unit 40 occurs. In the first embodiment, the transmission line 56 is a flexible member, and can be easily deformed. Thus, the position error between the connection portion 546 and the liquid ejecting unit 40 is absorbed by the deformation of the transmission line 56. In other words, the transmission line 56 according to the first embodiment functions as a connector body for coupling the connection portion 546 and the liquid ejecting unit 40 so as to absorb the position error between the connection portion 546 and the liquid ejecting unit 40.

According to the above configuration, in a step of attaching and detaching the connection portion 328 of the connection unit 32 to and from the connection portion 546, the stress that is applied from the connection portion 546 to the liquid ejecting unit 40 is reduced. Therefore, it is possible to easily assemble or disassemble the liquid ejecting head 24 without considering the stress that is applied from the connection portion 546 to the liquid ejecting unit 40 (further the position deviation of the liquid ejecting unit 40). In the first embodiment, as described above, since the transmission line 56 is bent between the connection portion 546 and the liquid ejecting unit 40, the effect that can absorb the position error between the connection portion 546 and the liquid ejecting unit 40 is particularly remarkable.

Figure 7:
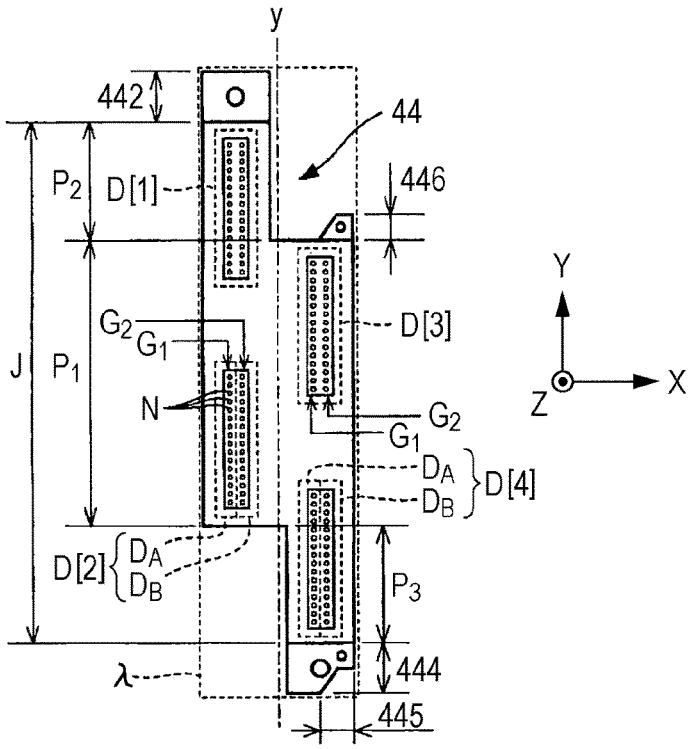
FIG. 7 is a plan view of an ejecting face.

FIG. 7 is a plan view of the surface of the liquid ejecting portion 44 that is opposite to the medium 12 (that is, a plan view of the liquid ejecting portion 44 when viewed from the positive Z-direction). As illustrated in FIG. 7, a plurality of nozzles (ejecting holes) N are formed on the face J of the liquid ejecting portion 44 that is opposite to the medium 12 (hereinafter, referred to as the "ejecting face"). As illustrated in FIG. 7, the liquid ejecting portion 44 according to the first embodiment includes four driving portions D[1] to D[4] each of which includes the plurality of nozzles N formed on the ejecting face J. The range in the Y-direction in which the plurality of nozzles N are distributed partially overlaps between the two driving portions D[n] (n=1 to 4).

As illustrated in FIG. 7, the plurality of nozzles N corresponding to any one driving portion D[n] are divided into a first column $G_1$ and a second column $G_2$. Each of the first column $G_1$ and the second column $G_2$ is a set of the plurality of nozzles N arranged along the Y-direction. The first column $G_1$ and the second column $G_2$ are disposed in parallel at a distance therebetween in the X-direction. Each driving portion D[n] includes a first ejecting portion $D_A$ that ejects the ink from each of the nozzles N of the first column $G_1$, and a second ejecting portion $D_B$ that ejects the ink from each of the nozzles N of the second column $G_2$. In each of the nozzles N of the first column $G_1$ and each of the nozzles N of the second column $G_2$, the position in the Y-direction can be also changed (so-called staggered arrangement or zigzag arrangement). The number of the driving portions D[n] that are provided in the liquid ejecting portion 44 is arbitrary, and not limited to four.

As illustrated in FIG. 7, assuming that there is a rectangle λ that has a minimum area including the ejecting face J, the center line y parallel to the long side (Y-direction) of the rectangle λ can be set. As illustrated in FIG. 7, the planar shape of the ejecting face J according to the first embodiment is a shape obtained by connecting a first portion $P_1$, a second portion $P_2$, and a third portion $P_3$ in the Y-direction (that is, the direction of the long side of the rectangle λ). The second portion $P_2$ is positioned at the side in the positive Y-direction when viewed from the first portion $P_1$, and the third portion $P_3$ is positioned at the side opposite to the second portion $P_2$ interposing the first portion $P_1$ (negative Y-direction). As can be understood from FIG. 7, the first portion $P_1$ passes through the center line y of the rectangle λ, but each of the second portion $P_2$ and the third portion $P_3$ do not pass through the center line y. Specifically, the second portion $P_2$ is positioned at the side in the negative X-direction when viewed from the center line y, and the third portion $P_3$ is positioned at the side in the positive X-direction when viewed from the center line y. That is, the second portion $P_2$ is positioned at the side opposite to the third portion $P_3$ interposing the center line y. The planar shape of the ejecting face J can be expressed as a shape in which the second portion $P_2$ is continuous to the edge side of the first portion $P_1$ in the negative X-direction and the third portion $P_3$ is continuous to the edge side of the first portion $P_1$ in the positive X-direction.

As illustrated in FIGS. 5 and 7, a protruding portion 442 and a protruding portion 444 are formed at the end surfaces of the liquid ejecting portion 44. The protruding portion 442 is a flat plate-shaped portion which protrudes from the end surface of the liquid ejecting portion 44 at the end portion of the second portion $P_2$ that is opposite to the first portion $P_1$ (the positive Y-direction). On the other hand, the protruding portion 444 is a flat plate-shaped portion which protrudes from the end surface of the liquid ejecting portion 44 at the end portion of the third portion $P_3$ that is opposite to the first portion $P_1$ (the negative Y-direction). As illustrated in FIG. 7, a projection portion 446 is formed at the edge side of the first portion $P_1$ at the second portion $P_2$ side (edge side at which the second portion $P_2$ is not present). The projection portion 446 is a flat plate-shaped portion (an example of a first protruding portion) which projects from the side surface of the liquid ejecting portion 44, in the same manner as those of the protruding portion 442 and the protruding portion 444. A notch portion 445 that has a shape corresponding to the projection portion 446 is formed at the protruding portion 444 (an example of a second protruding portion).

Figure 8:
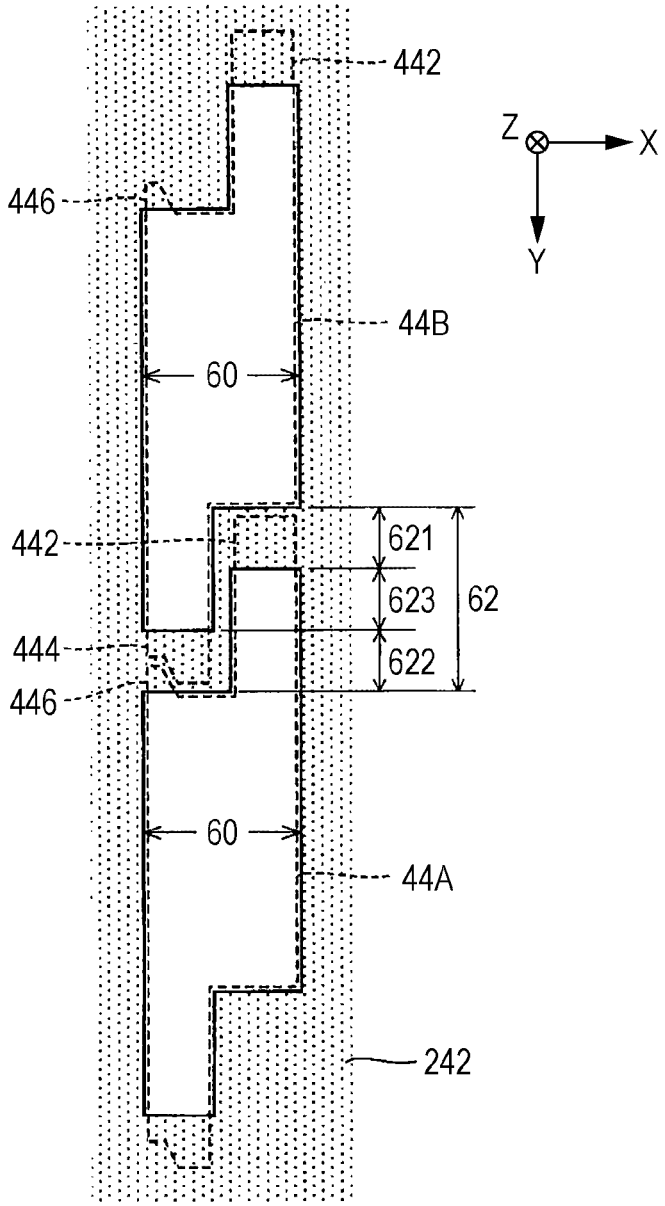
FIG. 8 is a plan view of a first support body.
Figure 9:
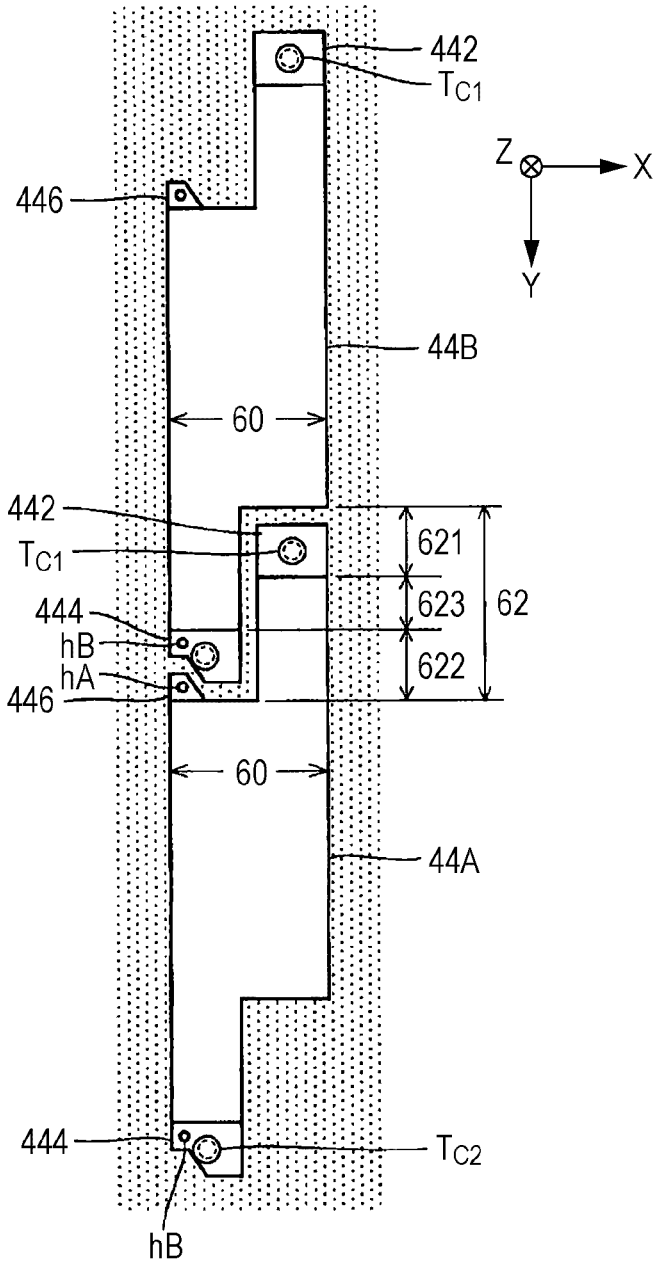
FIG. 9 is an explanatory view illustrating a state where a plurality of liquid ejecting units are fixed to the first support body.

FIG. 8 is a plan view of the surface (surface in the negative Z-direction) of the first support body 242, and FIG. 9 is a plan view in which the liquid ejecting portion 44 is additionally illustrated in FIG. 8. In FIGS. 8 and 9, the range in which two liquid ejecting portions 44 ($44_A$, $44_B$) that are adjacent with each other in the Y-direction are positioned is illustrated for convenience. As illustrated in FIGS. 8 and 9, opening portions 60 corresponding to each of the liquid ejecting portions 44 (each of the liquid ejecting modules 38) are formed in the first support body 242. Specifically, as can be understood from FIG. 2, six opening portions 60 corresponding to each of the liquid ejecting portions 44 are formed for each of the assemblies 244, and disposed in parallel in the Y-direction so as to correspond to the arrangement of the plurality of assemblies 244. As illustrated in FIGS. 8 and 9, each of the opening portions 60 is a through-hole that has a planar shape corresponding to the outer shape of the ejecting face J of the liquid ejecting portion 44. The liquid ejecting unit 40 is fixed to the first support body 242 in a state where the liquid ejecting portion 44 is inserted into the opening portion 60 of first support body 242. In other words, the ejecting face J of the liquid ejecting portion 44 is exposed from the first support body 242 in the positive Z-direction through the inner side of the opening portion 60.

As illustrated in FIGS. 8 and 9, a beam-shaped portion 62 is formed between two opening portions 60 that are adjacent with each other in the Y-direction. Any one beam-shaped portion 62 is a beam-shaped portion in which a first support portion 621, a second support portion 622, and an intermediate portion 623 are coupled to each other. The first support portion 621 is a portion that is positioned at the side of the beam-shaped portion 62 in the negative Y-direction, and the second support portion 622 is a portion that is positioned at the side of the beam-shaped portion 62 in the positive Y-direction. The intermediate portion 623 is a portion that couples the first support portion 621 and the second support portion 622.

As can be understood from FIG. 9, the protruding portion 442 of each liquid ejecting portion 44 overlaps with the first support portion 621 of the beam-shaped portion 62 in a plan view (that is, when viewed from a direction parallel to the Z-direction), and the protruding portion 444 of each liquid ejecting portion 44 overlaps with the second support portion 622 of the beam-shaped portion 62 in a plan view. The protruding portion 442 is fixed to the first support portion 621 by a fastener $T_{C1}$, and the protruding portion 444 is fixed to the second support portion 622 by a fastener $T_{C2}$. Thus, the liquid ejecting portion 44 is fixed to the first support body 242. The fastener $T_{C1}$ and the fastener $T_{C2}$ are a screw, for example. As described above, since the liquid ejecting portion 44 (liquid ejecting unit 40) is fixed to the first support body 242 at both ends of the ejecting face J, it is possible to effectively suppress the inclination of the liquid ejecting portion 44 with respect to the first support body 242. As illustrated in FIG. 9, focusing on the opening portion 60 corresponding to the liquid ejecting portion $\mathbf{44}_A$ and the opening portion 60 corresponding to the liquid ejecting portion $\mathbf{44}_B$, the protruding portion 442 of the liquid ejecting portion $\mathbf{44}_A$ is fixed to the first support portion 621 of the beam-shaped portion 62 between the opening portions 60, and the protruding portion 444 of the liquid ejecting portion $\mathbf{44}_B$ is fixed to the second support portion 622 of the beam-shaped portion 62.

An engagement hole hA is formed in the projection portion 446 of each liquid ejecting portion 44, and an engagement hole hB is formed in the protruding portion 444 together with a through-hole into which the fastener $T_{C2}$ is inserted. The engagement hole hA and the engagement hole hB are through-holes that engage with the projections provided on the surface of the first support body 242 (an example of a positioning portion). The projections of the surface of the first support body 242 engage with each of the engagement hole hA and the engagement hole hB, and thus the position of the liquid ejecting portion 44 in the X-Y plane is determined. That is, the alignment of the liquid ejecting portion 44 with respect to the first support body 242 is realized. As illustrated in FIG. 9, the engagement hole hA of the projection portion 446 and the engagement hole hB of the protruding portion 444 are positioned on a straight line parallel to the Y-direction (center line y). Accordingly, there is an advantage in that the liquid ejecting portion 44 can be positioned with high accuracy with respect to the first support body 242 while suppressing the inclination of the liquid ejecting portion 44 (liquid ejecting unit 40). In addition, the liquid ejecting portion 44 may also be positioned with respect to the first support body 242 by engaging the projections formed on the protruding portion 444 and the projection portion 446 with the engagement holes (bottomed holes or through-holes) of the surface of the first support body 242.

Figure 10:
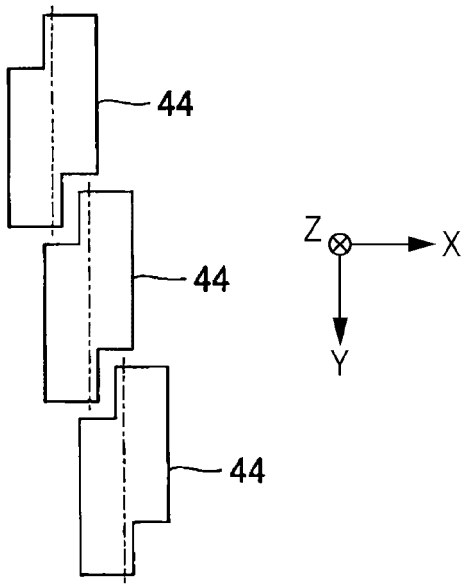
FIG. 10 is an explanatory view illustrating a comparative example.

As described above, in the first embodiment, the beam-shaped portion 62 is formed between the two opening portions 60 that are adjacent in the Y-direction, and thus there is an advantage in that the size of the first support body 242 in the X-direction can be reduced. In addition, in the first embodiment, the intermediate portion 623 is formed in the beam-shaped portion 62, and thus it is possible to maintain the mechanical strength of the first support body 242, compared to the configuration in which the opening portions 60 that expose the ejecting face J of the liquid ejecting portion 44 are continuous over the plurality of liquid ejecting portions 44 (configuration in which the beam-shaped portion 62 is not formed). In the configuration in which the second portion $P_2$ and the third portion $P_3$ of the ejecting face J pass through the center line y (hereinafter, referred to as a "comparative example"), in order to dispose the plurality of liquid ejecting portions 44 at the positions that are close enough in the Y-direction, as illustrated in FIG. 10, it is necessary that the position in the X-direction of each of the liquid ejecting portions 44 is made different from each other. In first embodiment, the second portion $P_2$ and the third portion $P_3$ do not pass through the center line y, and thus, as illustrated FIG. 9, it is possible to arrange the plurality of liquid ejecting portions 44 in a linear shape along the Y-direction. Accordingly, there is an advantage in that the size in the width direction of the liquid ejecting head 24 (one assembly 244) can be reduced compared to the comparative example.

Figure 11:
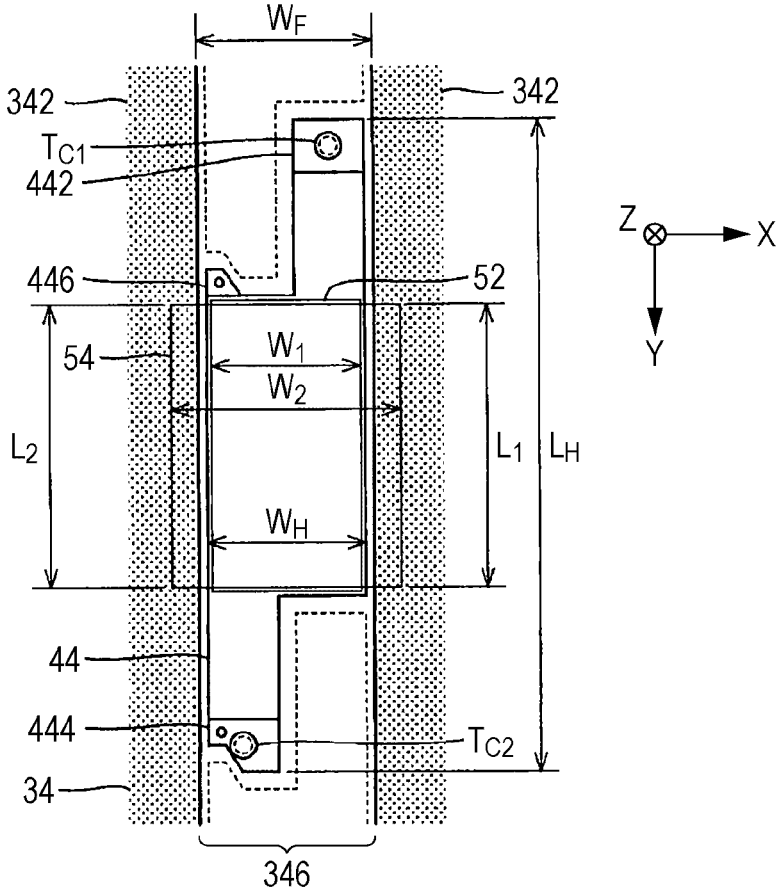
FIG. 11 is an explanatory view illustrating the relationship between an opening portion of the second support body and the liquid ejecting module.

FIG. 11 is a plan view illustrating the relationship among the liquid ejecting unit 40, the coupling unit 50, and the second support body 34. As illustrated in FIG. 11, the dimension $W_H$ in the X-direction of the liquid ejecting unit 40 is less than the dimension $W_F$ in the X-direction of the opening portion 346 of the second support body 34 ($W_H<W_F$). As described above with reference to FIG. 6, since the dimension $W_1$ of the first relay body 52 is also less than the dimension $W_F$ of the opening portion 346, the liquid ejecting unit 40 and the first relay body 52 can pass through the opening portion 346 of the second support body 34. As described above, it is possible to attach and detach the liquid ejecting unit 40 and the second relay body 54 by passing through the opening portion 346 of the second support body 34. Thus, according to the first embodiment, it is possible to reduce the burden in the assembly and disassembly of the liquid ejecting head 24.

As illustrated in FIG. 11, the dimension $L_1$ in the Y-direction of the first relay body 52 and the dimension $L_2$ in the Y-direction of the second relay body 54 are less than the dimension $L_H$ in the Y-direction of the liquid ejecting unit 40 ($L_1<L_H$, $L_2<L_H$). Therefore, in a state where the outer wall surfaces of the both sides in the Y-direction of the first relay body 52 are held with fingers, it is possible to easily attach and detach the liquid ejecting module 38 to and from the second support body 34. As illustrated in FIG. 11, the first relay body 52 and the second relay body 54 do not overlap with the fastener $T_{C1}$ and the fastener $T_{C2}$ for fixing the liquid ejecting unit 40 to the first support body 242 in a plan view. Therefore, there is an advantage in that the work for fixing the liquid ejecting unit 40 to the first support body 242 by the fastener $T_{C1}$ and the fastener $T_{C2}$ is easy.

Figure 12:
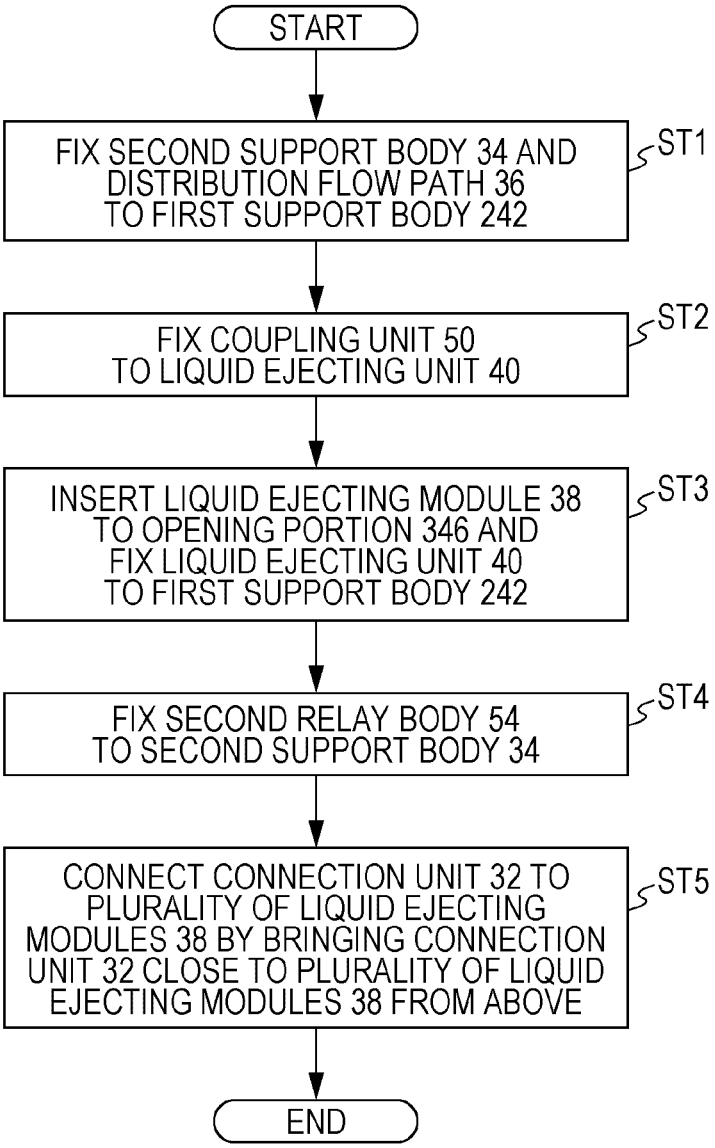
FIG. 12 is an explanatory diagram illustrating a method for manufacturing the liquid ejecting head.

FIG. 12 is a flowchart of a method for manufacturing the liquid ejecting head 24. As illustrated in FIG. 12, first, the second support body 34 and the distribution flow path 36 are fixed to the first support body 242 (ST1). On the other hand, the liquid ejecting module 38 is assembled by fixing the coupling unit 50 to the liquid ejecting unit 40 using the fasteners $T_A$ (ST2). Step ST2 may be executed before step ST1 is executed.

In step ST3 after step ST1 and step ST2 are executed, for each of the plurality of liquid ejecting modules 38, the liquid ejecting module 38 is inserted from the side opposite to the first support body 242 to the opening portion 346 of the second support body 34, and the liquid ejecting unit 40 is fixed to the first support body 242 by the fastener $T_{C1}$ and the fastener $T_{C2}$ (ST3). In the process in which the liquid ejecting module 38 is inserted to the opening portion 346 and brought close to the first support body 242, the valve mechanism unit 41 and the distribution flow path 36 communicate with each other. In step ST4 after step ST3 is executed, for each of the plurality of liquid ejecting modules 38, the second relay body 54 of the coupling unit 50 is fixed to the second support body 34 by the fasteners $T_B$. Step ST4 may be executed before step ST3 is executed.

In step ST5 after step ST3 and step ST4 are executed, the connection unit 32 is brought close to each of the liquid ejecting modules 38 interposing the coupling unit 50, from the side opposite to the liquid ejecting unit 40 (negative Z-direction). The connection portion 546 and the connection portion 328 of the connection unit 32 are collectively and detachably connected to the plurality of liquid ejecting modules 38.

According to the above steps (ST1 to ST5), one assembly 244 including the connection unit 32, the second support body 34, the distribution flow path 36, and the plurality of liquid ejecting modules 38 is provided on the first support body 242. The plurality of assemblies 244 are fixed to the first support body 242 by repeating the same step, and thus the liquid ejecting head 24 illustrated in FIG. 2 is manufactured.

As can be understood from the above description, step ST3 is a step of fixing the liquid ejecting unit 40 to the first support body 242, and step ST4 is a step of fixing the coupling unit 50 to the second support body 34. Step ST5 is a step of detachably connecting the connection portion 546 and the connection portion 328 by bring the connection unit 32 close to the plurality of liquid ejecting modules 38. The manufacturing method of the liquid ejecting head 24 is not limited to the method described above.

Figure 13:
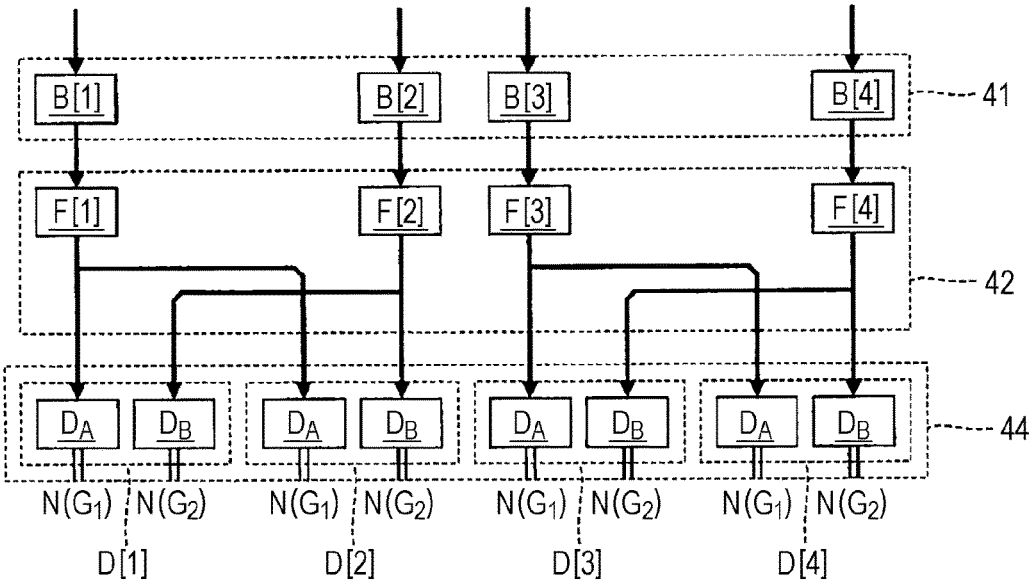
FIG. 13 is an explanatory diagram illustrating a flow path for supplying ink to a liquid ejecting portion.

The specific configuration of the liquid ejecting unit 40 described above will be described. FIG. 13 is an explanatory diagram of the flow path for supplying the ink to the liquid ejecting unit 40. As described above with reference to FIG. 5, the liquid ejecting portion 44 of the liquid ejecting unit 40 includes four driving portions D[1] to D[4]. Each driving portion D[n] includes a first ejecting portion $D_A$ that ejects the ink from each nozzle N of the first column $G_1$, and a second ejecting portion $D_B$ that ejects the ink from each nozzle N of the second column $G_2$. As illustrated in FIG. 13, the valve mechanism unit 41 includes four opening/closing valves B[1] to B[4], and the flow path unit 42 of the liquid ejecting unit 40 includes four filters F[1] to F[4]. The opening/closing valve B[n] is a valve mechanism that opens and closes the flow path for supplying the ink to the liquid ejecting portion 44. The filter F[n] collects air bubbles or foreign matters mixed into the ink in the flow path.

As illustrated in FIG. 13, the ink that passes through the opening/closing valve B[1] and the filter F[1] is supplied to the first ejecting portions $D_A$ of the driving portion D[1] and the driving portion D[2], and the ink that passes through the opening/closing valve B[2] and the filter F[2] is supplied to the second ejecting portions $D_B$ of the driving portion D[1] and the driving portion D[2]. Similarly, the ink that passes through the opening/closing valve B[3] and the filter F[3] is supplied to the first ejecting portions $D_A$ of the driving portion D[3] and the driving portion D[4], and the ink that passes through the opening/closing valve B[4] and the filter F[4] is supplied to the second ejecting portions $D_B$ of the driving portion D[3] and the driving portion D[4]. In other words, the ink that passes through the opening/closing valve B[1] or the opening/closing valve B[3] is ejected from each nozzle N of the first column $G_1$, and the ink that passes through the opening/closing valve B[2] or the opening/closing valve B[4] is ejected from each nozzle N of the second column $G_2$.

Figure 14:
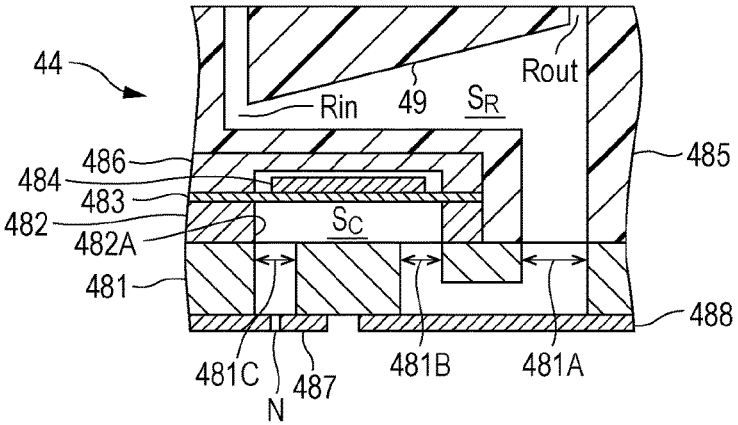
FIG. 14 is a sectional view of the liquid ejecting portion.

FIG. 14 is a sectional view of the portion corresponding to any one nozzle N of the liquid ejecting portion 44 (first ejecting portion $D_A$ or second ejecting portion $D_B$). As illustrated in FIG. 14, the liquid ejecting portion 44 according to the first embodiment is a structure in which a pressure chamber substrate 482, a vibration plate 483, a piezoelectric element 484, a housing portion 485, and a sealing body 486 are disposed on one side of a flow path substrate 481, and in which a nozzle plate 487 and a buffer plate 488 are disposed on the other side of the flow path substrate 481. The flow path substrate 481, the pressure chamber substrate 482, and the nozzle plate 487 are formed with, for example, a flat plate member of silicon, and the housing portion 485 is formed, for example, by injection molding of a resin material. The plurality of nozzles N are formed in the nozzle plate 487. The surface of the nozzle plate 487 that is opposite to the flow path substrate 481 corresponds to the ejecting face J.

In the flow path substrate 481, an opening portion 481A, a branch flow path (throttle flow path) 481B, and a communication flow path 481C are formed. The branch flow path 481B and the communication flow path 481C are a through-hole that is formed for each of the nozzles N, and the opening portion 481A is an opening that is continuous across the plurality of nozzles N. The buffer plate 488 is a flat plate member which is provided on the surface of the flow path substrate 481 that is opposite to the pressure chamber substrate 482 and closes the opening portion 481A (a compliance substrate). The pressure variation in the opening portion 481A is absorbed by the buffer plate 488.

In the housing portion 485, a common liquid chamber (reservoir) $S_R$ that communicates with the opening portion 481A of the flow path substrate 481 is formed. The common liquid chamber $S_R$ is a space for storing the ink to be supplied to the plurality of nozzles N that constitute one of the first column $G_1$ and the second column $G_2$, and is continuous across the plurality of nozzles N. An inflow port $R_{in}$ into which the ink supplied from the upstream side flows is formed in the common liquid chamber $S_R$.

An opening portion 482A is formed in the pressure chamber substrate 482 for each of the nozzles N. The vibration plate 483 is a flat plate member which is elastically deformable and provided on the surface of the pressure chamber substrate 482 that is opposite to the flow path substrate 481. The space that is interposed between the vibration plate 483 and the flow path substrate 481 at the inside of the opening portion 482A of the pressure chamber substrate 482 functions as a pressure chamber $S_C$ (cavity) in which the ink supplied through the branch flow path 481B from the common liquid chamber $S_R$ is filled. Each pressure chamber $S_C$ communicates with the nozzles N through the communication flow path 481C of the flow path substrate 481.

The piezoelectric element 484 is formed on the surface of the vibration plate 483 that is opposite to the pressure chamber substrate 482 for each of the nozzles N. Each piezoelectric element 484 is a driving element in which a piezoelectric body is interposed between electrodes that are opposite to each other. When the piezoelectric element 484 is deformed by the supply of the driving signal and thus the vibration plate 483 is vibrated, the pressure in the pressure chamber $S_C$ varies, and thus the ink in the pressure chamber $S_C$ is ejected from the nozzles N. The sealing body 486 protects each piezoelectric element 484.

Figure 15:
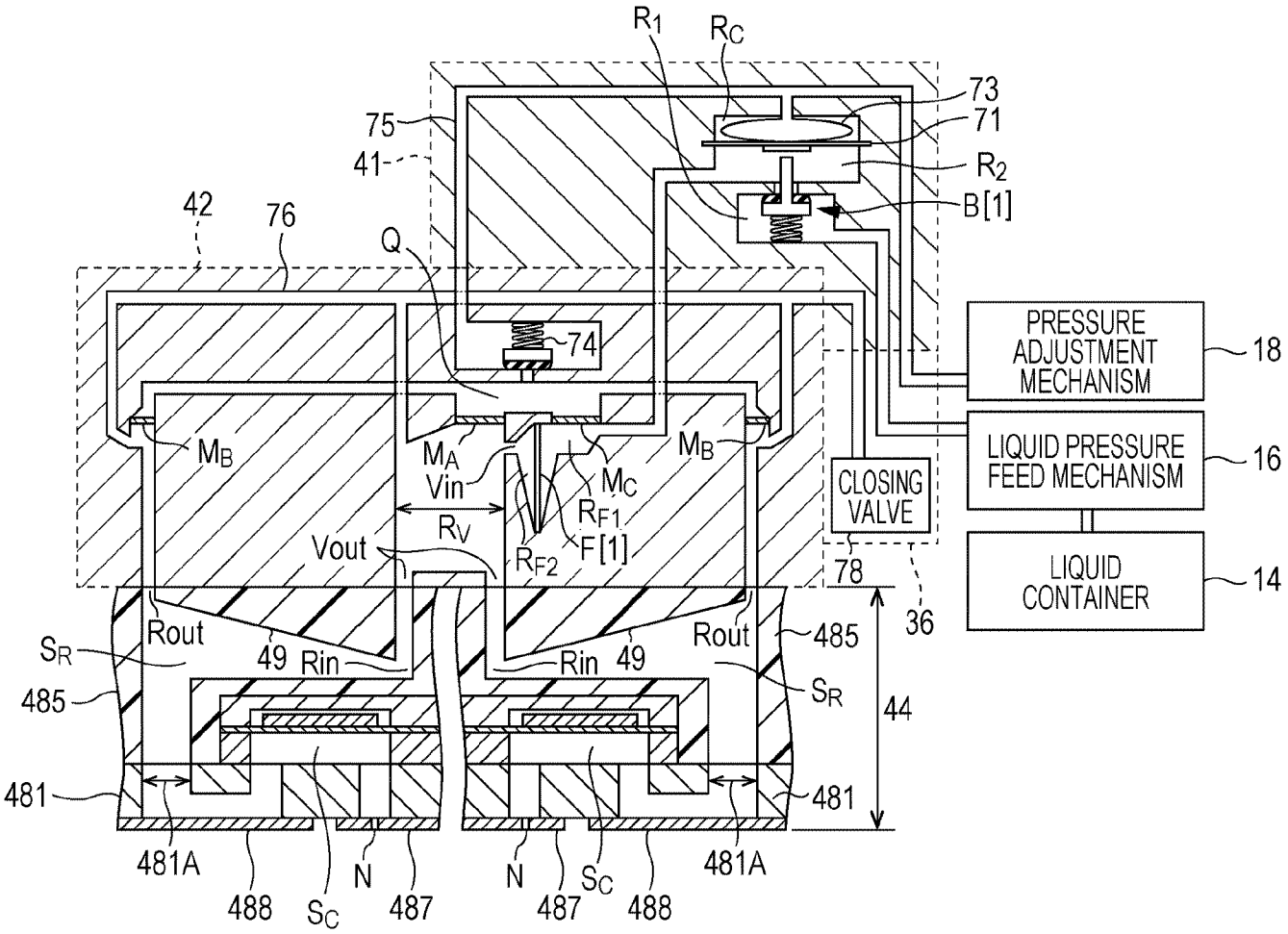
FIG. 15 is an explanatory diagram illustrating the internal flow path of the liquid ejecting unit.

FIG. 15 is an explanatory diagram of the internal flow path of the liquid ejecting unit 40. In FIG. 15, for convenience, although the flow path for supplying the ink to the first ejecting portions $D_A$ of the driving portion D[1] and the driving portion D[2] through the opening/closing valve B[1] and the filter F[1] is illustrated, the same configuration is provided for the other flow paths that are described with reference to FIG. 13. The valve mechanism unit 41, the flow path unit 42, and the housing portion 485 of the liquid ejecting portion 44 function as a flow path structure that constitutes the internal flow path for supplying the ink to the nozzles N.

Figure 16:
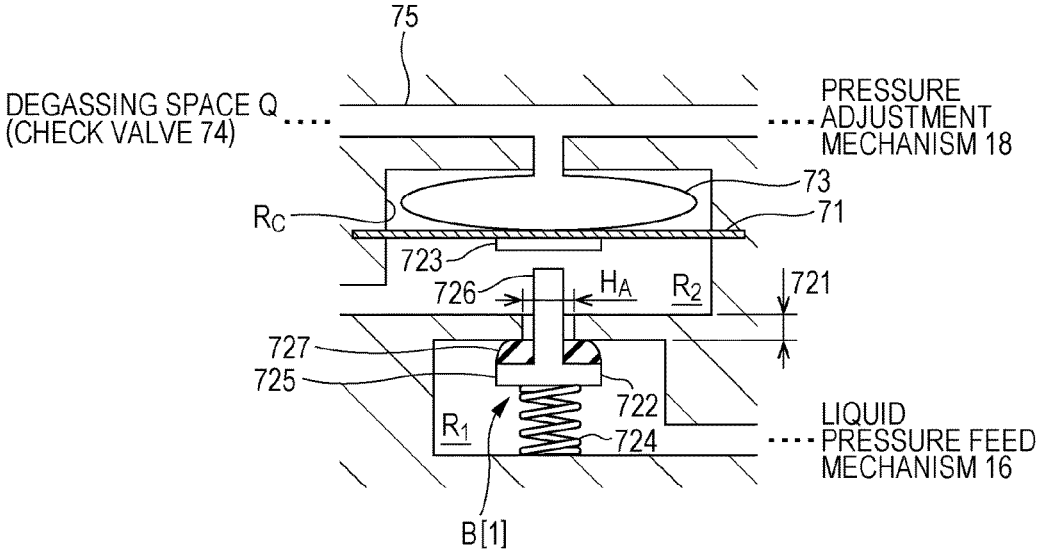
FIG. 16 is a configuration diagram of an opening/closing valve of a valve mechanism unit.

FIG. 16 is an explanatory diagram focusing on the inside of the valve mechanism unit 41. As illustrated in FIGS. 15 and 16, a space $R_1$, a space $R_2$, and a control chamber $R_C$ are formed in the inside of the valve mechanism unit 41. The space $R_1$ is connected to a liquid pressure feed mechanism 16 through the distribution flow path 36 and the first connection port 79*a*. The liquid pressure feed mechanism 16 is a mechanism that supplies (that is, pressure-feeds) the ink stored in the liquid container 14 to the liquid ejecting unit 40 in a pressurized state. The opening/closing valve B[1] is provided between the space $R_1$ and the space $R_2$, and a movable film 71 is interposed between the space $R_2$ and the control chamber $R_C$. As illustrated in FIG. 16, the opening/closing valve B[1] includes a valve seat 721, a valve body 722, a pressure receiving plate 723, and a spring 724. The valve seat 721 is a flat plate-shaped portion that partitions the space $R_1$ and the space $R_2$. In the valve seat 721, a communication hole $H_A$ that allows the space $R_1$ to communicate with the space $R_2$ is formed. The pressure receiving plate 723 is a substantially circular-shaped flat plate member which is provided on the surface of the movable film 71 that faces the valve seat 721.

The valve body 722 according to the first embodiment includes a base portion 725, a valve shaft 726, and a sealing portion (seal) 727. The valve shaft 726 projects vertically from the surface of the base portion 725, and the ring-shaped sealing portion 727 that surrounds the valve shaft 726 in a plan view is provided on the surface of the base portion 725. The valve body 722 is disposed within the space $R_1$ in the state where the valve shaft 726 is inserted into the communication hole $H_A$, and biased to the valve seat 721 side by the spring 724. A gap is formed between the outer peripheral surface of the valve shaft 726 and the inner peripheral surface of the communication hole $H_A$.

As illustrated in FIG. 16, a bag-shaped body 73 is provided in the control chamber $R_C$. The bag-shaped body 73 corresponds to a first chamber. The bag-shaped body 73 is a bag-shaped member that is formed with an elastic material such as rubber or the like, expands by pressurization in the internal space, and contracts by depressurization in the internal space. As illustrated in FIG. 15, the bag-shaped body 73 is connected to a pressure adjustment mechanism 18 via the flow path in the distribution flow path 36 and the second connection port 75*b*. The pressure adjustment mechanism 18 can selectively execute a pressurization operation for supplying air to the flow path that is connected to the pressure adjustment mechanism 18, and a depressurization operation for sucking air from the flow path, according to an instruction from the control unit 20. The bag-shaped body 73 expands by supplying air from the pressure adjustment mechanism 18 to the internal space (that is, pressurizing), and the bag-shaped body 73 contracts by sucking air using the pressure adjustment mechanism 18 (that is, depressurizing).

In the state where the bag-shaped body 73 is contracted, in a case where the pressure in the space $R_2$ is maintained within a predetermined range, the valve body 722 is biased by the spring 724, and thus the sealing portion 727 is brought to close contact with the surface of the valve seat 721. Therefore, the space $R_1$ and the space $R_2$ are separated from each other. On the other hand, when the pressure in the space $R_2$ is lowered to a value less than a predetermined threshold value due to the ejection of the ink by the liquid ejecting portion 44 or the suction of the ink from the outside, the movable film 71 is displaced to the valve seat 721 side, and thus the pressure receiving plate 723 pressurize the valve shaft 726. As a result, the valve body 722 is moved against biasing by the spring 724, and thus the sealing portion 727 is separated from the valve seat 721. Therefore, the space $R_1$ and the space $R_2$ communicate with each other via the communication hole $H_A$.

When the bag-shaped body 73 expands due to the pressurization by the pressure adjustment mechanism 18, the movable film 71 is displaced to the valve seat 721 side due to the pressurization by the bag-shaped body 73. Therefore, the valve body 722 is moved due to the pressurization by the pressure receiving plate 723, and thus the opening/closing valve B[1] is opened. In other words, regardless of the level of the pressure in the space $R_2$, it is possible to forcibly open the opening/closing valve B[1] by the pressurization by the pressure adjustment mechanism 18.

As illustrated in FIG. 15, the flow path unit 42 according to the first embodiment includes a degassing space Q, a filter F[1], a vertical space $R_V$, and a check valve 74. The degassing space Q is a space in which an air bubble extracted from the ink temporarily stays. The degassing space Q corresponds to a second chamber.

The filter F[1] is provided so as to cross the internal flow path for supplying the ink to the liquid ejecting portion 44, and collects air bubbles or foreign matters mixed into the ink. Specifically, the filter F[1] is provided so as to partition the space $R_{F1}$ and the space $R_{F2}$. The space $R_{F1}$ at the upstream side communicates with the space $R_2$ of the valve mechanism unit 41, and the space $R_{F2}$ at the downstream side communicates with the vertical space $R_V$.

A gas-permeable film $M_C$ (an example of a second gas-permeable film) is interposed between the space $R_{F1}$ and the degassing space Q. Specifically, the ceiling surface of the space $R_{F1}$ is configured with the gas-permeable film $M_C$. The gas-permeable film $M_C$ is a gas-permeable film body that transmits gas (air) and does not transmit liquid such as ink or the like (gas-liquid separation film), and is formed with, for example, a known polymer material. The air bubble collected by the filter F[1] reaches the ceiling surface of the space $R_{F1}$ due to the rise by buoyancy, passes through the gas-permeable film $M_C$, and is discharged to the degassing space Q. In other words, the air bubble mixed into the ink is separated.

The vertical space $R_V$ is a space for temporarily storing the ink. In the vertical space $R_V$ according to the first embodiment, an inflow port $V_{in}$ into which the ink passed through the filter F[1] flows from the space $R_{F2}$, and outflow ports $V_{out}$ through which the ink flows out to the nozzles N side are formed. In other words, the ink in the space $R_{F2}$ flows into the vertical space $R_V$ via the inflow port $V_{in}$, and the ink in the vertical space $R_V$ flows into the liquid ejecting portion 44 (common liquid chamber $S_R$) via the outflow ports $V_{out}$. As illustrated in FIG. 15, the inflow port $V_{in}$ is positioned at the position higher than the outflow ports $V_{out}$ in the vertical direction (negative Z-direction).

A gas-permeable film $M_A$ (an example of a first gas-permeable film) is interposed between the vertical space $R_V$ and the degassing space Q. Specifically, the ceiling surface of the vertical space $R_V$ is configured with the gas-permeable film $M_A$. The gas-permeable film $M_A$ is a gas-permeable film body that is similar to the gas-permeable film $M_C$ described above. Accordingly, the air bubble that passed through the filter F[1] and entered into the vertical space $R_V$ rises by the buoyancy, passes through the gas-permeable film $M_A$ of the ceiling surface of the vertical space $R_V$, and is discharged to the degassing space Q. As described above, the inflow port $V_{in}$ is positioned at the position at the position higher than the outflow ports $V_{out}$ in the vertical direction, and thus the air bubble can effectively reach the gas-permeable film $M_A$ of the ceiling surface using the buoyancy in the vertical space $R_V$.

In the common liquid chamber $S_R$ of the liquid ejecting portion 44, as described above, the inflow port $R_{in}$ into which the ink supplied from the outflow port $V_{out}$ of the vertical space $R_V$ flows is formed. In other words, the ink that flowed out from the outflow port $V_{out}$ of the vertical space $R_V$ flows into the common liquid chamber $S_R$ via the inflow port $R_{in}$, and is supplied to each pressure chamber $S_C$ through the opening portion 481A. In the common liquid chamber $S_R$ according to the first embodiment, a discharge port $R_{out}$ is formed. The discharge port $R_{out}$ is a flow path that is formed on the ceiling surface 49 of the common liquid chamber $S_R$. As illustrated in FIG. 15, the ceiling surface 49 of the common liquid chamber $S_R$ is an inclined surface (flat surface or curved surface) which rises from the inflow port $R_{in}$ side to the discharge port $R_{out}$ side. Therefore, the air bubble that is entered from the inflow port $R_{in}$ is guided to the discharge port $R_{out}$ side along the ceiling surface 49 by the action of the buoyancy.

A gas-permeable film $M_B$ (an example of a first gas-permeable film) is interposed between the common liquid chamber $S_R$ and the degassing space Q. The gas-permeable film $M_B$ is a gas-permeable film body that is similar to the gas-permeable film $M_A$ or the gas-permeable film $M_C$. Therefore, the air bubble that is entered from the common liquid chamber $S_R$ to the discharge port $R_{out}$ rises by the buoyancy, passes through the gas-permeable film $M_B$, and is discharged to the degassing space Q. As described above, the air bubble in the common liquid chamber $S_R$ is guided to the discharge port $R_{out}$ along the ceiling surface 49, and thus it is possible to effectively discharge the air bubble in the common liquid chamber $S_R$, compared to a configuration in which, for example, the ceiling surface 49 of the common liquid chamber $S_R$ is a horizontal plane. The gas-permeable film $M_A$, the gas-permeable film $M_B$, and the gas-permeable film $M_C$ may be formed with a single film body.

As described above, in the first embodiment, the gas-permeable film $M_A$ is interposed between the vertical space $R_V$ and the degassing space Q, the gas-permeable film $M_B$ is interposed between the common liquid chamber $S_R$ and the degassing space Q, and the gas-permeable film $M_C$ is interposed between the space $R_{F1}$ and the degassing space Q. In other words, the air bubbles that passed through each of the gas-permeable film $M_A$, the gas-permeable film $M_B$, and the gas-permeable film $M_C$ reach the common degassing space Q. Therefore, there is an advantage in that the structure for discharging the air bubbles is simplified, compared to a configuration in which the air bubbles extracted in each unit of the liquid ejecting unit 40 are supplied to each individual space.

As illustrated in FIG. 15, the degassing space Q communicates with a degassing path 75. The degassing path 75 is a path for discharging the air stayed in the degassing space Q to the outside of the apparatus. The check valve 74 is interposed between the degassing space Q and the degassing path 75. The check valve 74 is a valve mechanism that allows the circulation of air directed to the degassing path 75 from the degassing space Q, on the one hand, and inhibits the circulation of air directed to the degassing space Q from the degassing path 75.

Figure 17:
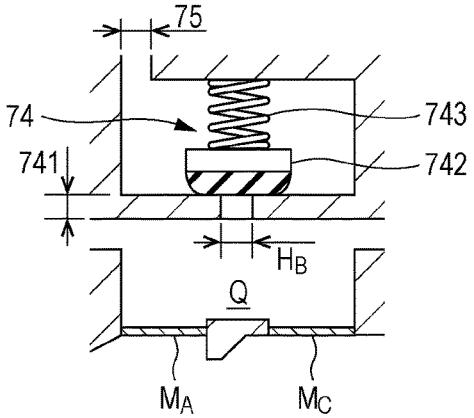
FIG. 17 is an explanatory diagram illustrating a degassing space and a check valve.

FIG. 17 is an explanatory diagram focusing on the vicinity of the check valve 74 of the flow path unit 42. As illustrated in FIG. 17, the check valve 74 according to the first embodiment includes a valve seat 741, a valve body 742, and a spring 743. The valve seat 741 is a flat plate-shaped portion that partitions the degassing space Q and the degassing path 75. In the valve seat 741, a communication hole HB that allows the degassing space Q to communicate with the degassing path 75 is formed. The valve body 742 is opposite to the valve seat 741, and biased to the valve seat 741 side by the spring 743. In a state where the pressure in the degassing path 75 is maintained to the pressure equal to or greater than the pressure in the degassing space Q (state where the inside of the degassing path 75 is opened to the atmosphere or pressurized), the valve body 742 is brought to close contact with the valve seat 741 by biasing of the spring 743, and thus the communication hole HB is closed. Therefore, the degassing space Q and the degassing path 75 are separated from each other. On the other hand, in a state where the pressure in the degassing path 75 is less than the pressure in the degassing space Q (state where the inside of the degassing path 75 is depressurized), the valve body 742 is separated from the valve seat 741 against biasing by the spring 743. Therefore, the degassing space Q and the degassing path 75 communicate with each other via the communication hole HB.

The degassing path 75 according to the first embodiment is connected to the path for coupling the pressure adjustment mechanism 18 and the control chamber $R_C$ of the valve mechanism unit 41. In other words, the path connected to the pressure adjustment mechanism 18 is branched into two systems, and one of the two systems is connected to the control chamber $R_C$ and the other of the two systems is connected to the degassing path 75.

As illustrated in FIG. 15, a discharge path 76 that starts from the liquid ejecting unit 40 and reaches the inside of the distribution flow path 36 via the valve mechanism unit 41 is formed. The discharge path 76 is a path that communicates with the internal flow path of the liquid ejecting unit 40 (specifically, the flow path for supplying the ink to the liquid ejecting portion 44). Specifically, the discharge path 76 communicates with the discharge port $R_{out}$ of the common liquid chamber $S_R$ of each liquid ejecting portion 44 and the vertical space $R_V$.

The end of the discharge path 76 that is opposite to the liquid ejecting unit 40 is connected to a closing valve 78. The position at which the closing valve 78 is provided is arbitrary, but the configuration in which the closing valve 78 is provided in the distribution flow path 36 is illustrated in FIG. 15. The closing valve 78 is a valve mechanism that can close the discharge path 76 in a normal state (normally close) and temporarily open the discharge path 76 to the atmosphere.

Figure 18:
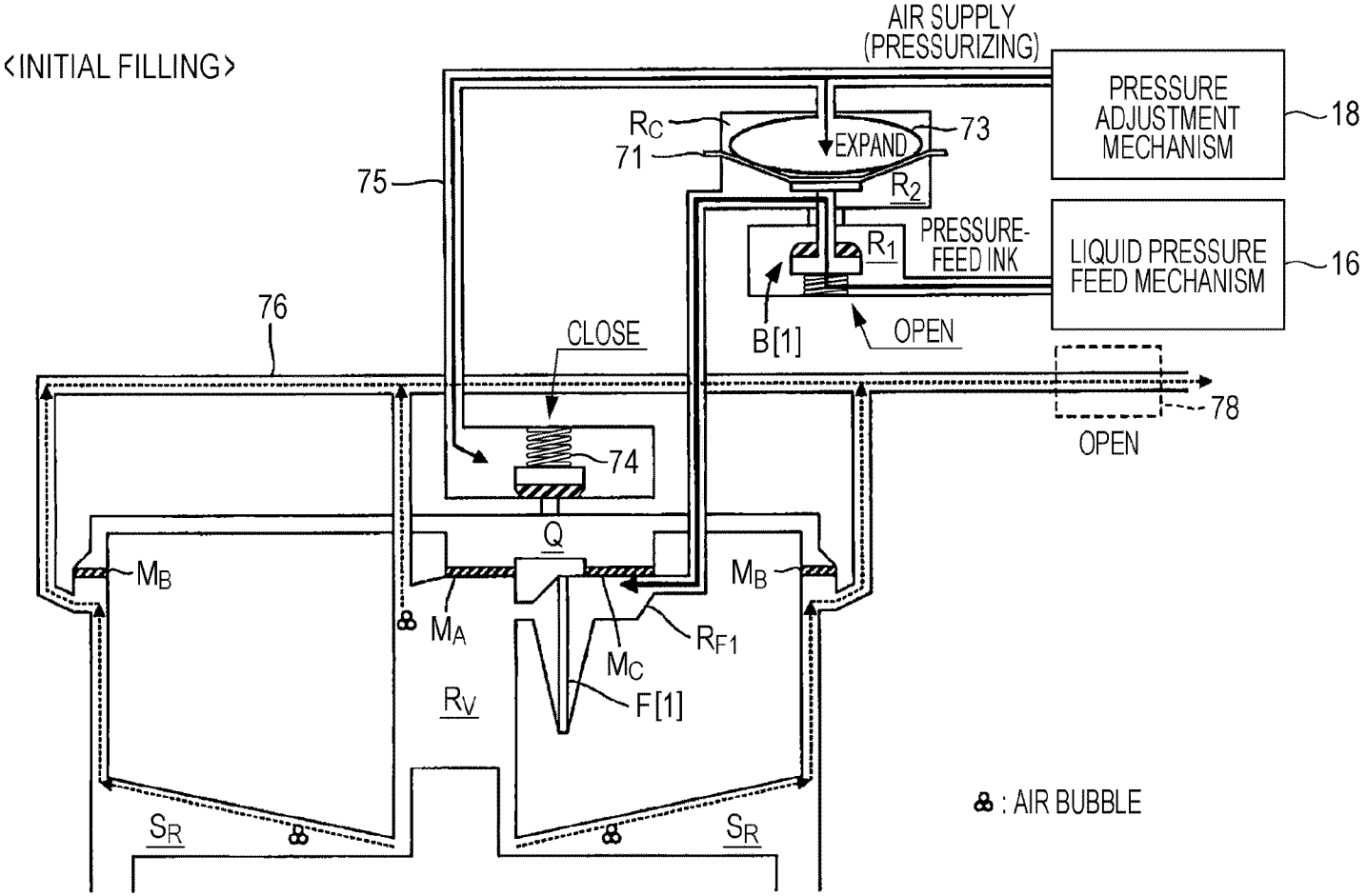
FIG. 18 is an explanatory diagram illustrating a state of the liquid ejecting head at the time of initial filling.

The operation of the liquid ejecting unit 40 will be described focusing on the discharge of the air bubble from the internal flow path. As illustrated in FIG. 18, in the stage of initially filling the liquid ejecting unit 40 with the ink (hereinafter, referred to as "initial filling"), the pressure adjustment mechanism 18 executes the pressurization operation. In other words, the internal space of the bag-shaped body 73 and the inside of the degassing path 75 are pressurized by the supply of air. Therefore, the bag-shaped body 73 in the control chamber $R_C$ expands, and thus the movable film 71 and the pressure receiving plate 723 are displaced. As a result, the valve body 722 is moved due to the pressurization by the pressure receiving plate 723, and thus the space $R_1$ and the space $R_2$ communicate with each other. In a state where the degassing path 75 is pressurized, the degassing space Q and the degassing path 75 are separated from each other by the check valve 74, and thus the air in the degassing path 75 does not flow into the degassing space Q. On the other hand, in the initial filling stage, the closing valve 78 is opened.

In the above state, the liquid pressure feed mechanism 16 pressure-feeds the ink stored in the liquid container 14 to the internal flow path of the liquid ejecting unit 40. Specifically, the ink that is pressure-fed from the liquid pressure feed mechanism 16 is supplied to the vertical space $R_V$ via the opening/closing valve B[1] in the open state, and supplied from the vertical space $R_V$ to the common liquid chamber $S_R$ and each pressure chamber $S_C$. As described above, since the closing valve 78 is opened, the air that is present in the internal flow path before the execution of the initial filling passes through the discharge path 76 and the closing valve 78, and is discharged to the outside of the apparatus, at the same timing of filling the internal flow path and the discharge path 76 with the ink. Therefore, the entire internal flow path including the common liquid chamber $S_R$ and each pressure chamber $S_C$ of the liquid ejecting unit 40 is filled with the ink, and thus the nozzles N can eject the ink by the operation of the piezoelectric element 484. As described above, in the first embodiment, the closing valve 78 is opened when the ink is pressure-fed from the liquid pressure feed mechanism 16 to the liquid ejecting unit 40, and thus it is possible to efficiently fill the internal flow path of the liquid ejecting unit 40 with the ink. When the initial filling described above is completed, the pressurization operation by the pressure adjustment mechanism 18 is stopped, and the closing valve 78 is closed.

Figure 19:
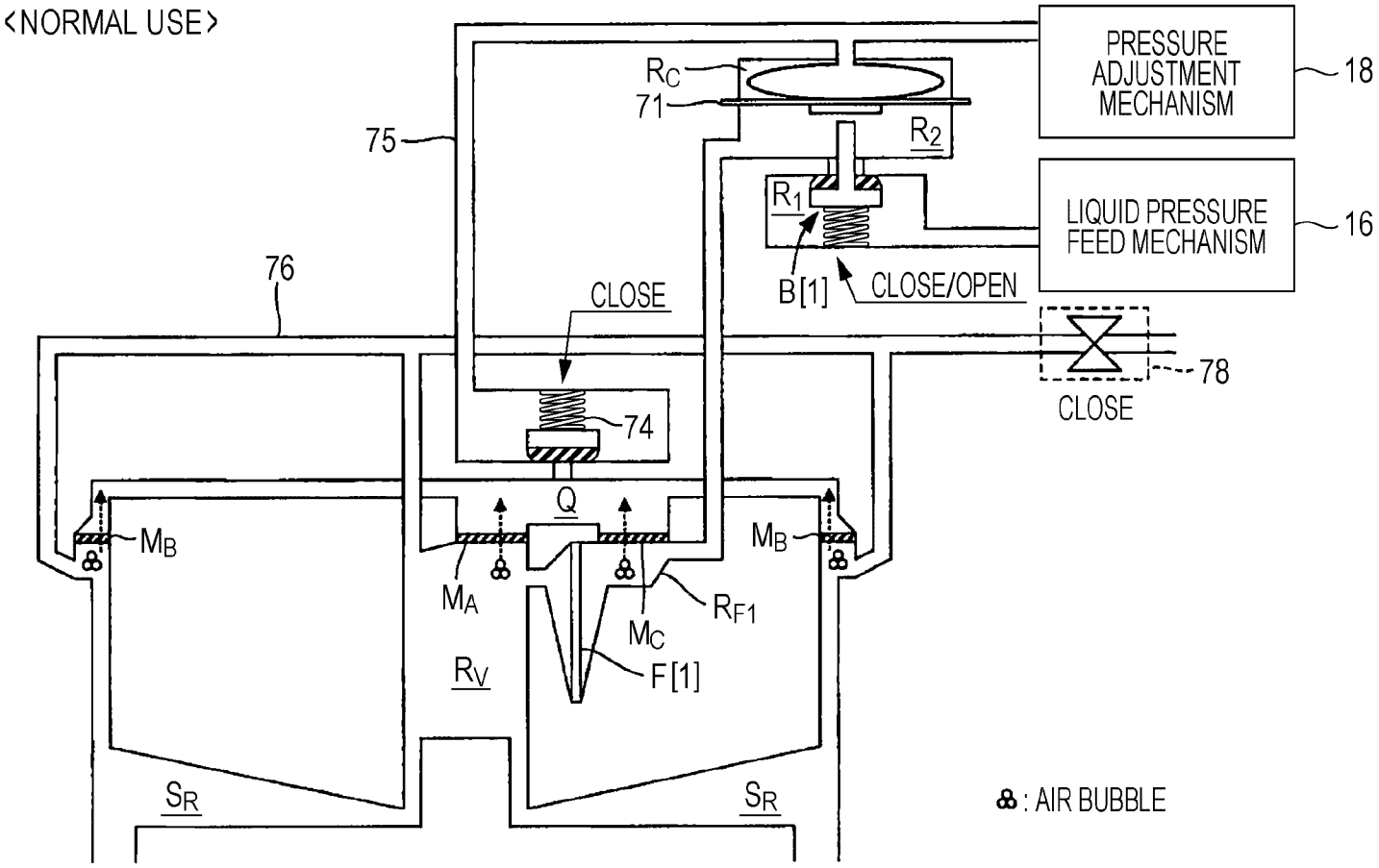
FIG. 19 is an explanatory diagram illustrating a state of the liquid ejecting head at the time of normal use.

As illustrated in FIG. 19, in a state where the initial filling is completed and thus the liquid ejecting apparatus 100 can be used, the air bubble that is present in the internal flow path of the liquid ejecting unit 40 is discharged at all times to the degassing space Q. More specifically, the air bubble in the space $R_{F1}$ is discharged to the degassing space Q via the gas-permeable film $M_C$, the air bubble in the vertical space $R_V$ is discharged to the degassing space Q via the gas-permeable film $M_A$, and the air bubble in the common liquid chamber $S_R$ is discharged to the degassing space Q via the gas-permeable film $M_B$. On the other hand, the opening/closing valve B[1] is closed in a state where the pressure in the space $R_2$ is maintained within a predetermined range, and opened in a state where the pressure in the space $R_2$ is less than a predetermined threshold value. When the opening/closing valve B[1] is opened, the ink supplied from the liquid pressure feed mechanism 16 flows from the space $R_1$ to the space $R_2$, and as a result, the pressure of the space $R_2$ increases. Thus, the opening/closing valve B[1] is closed.

Figure 20:
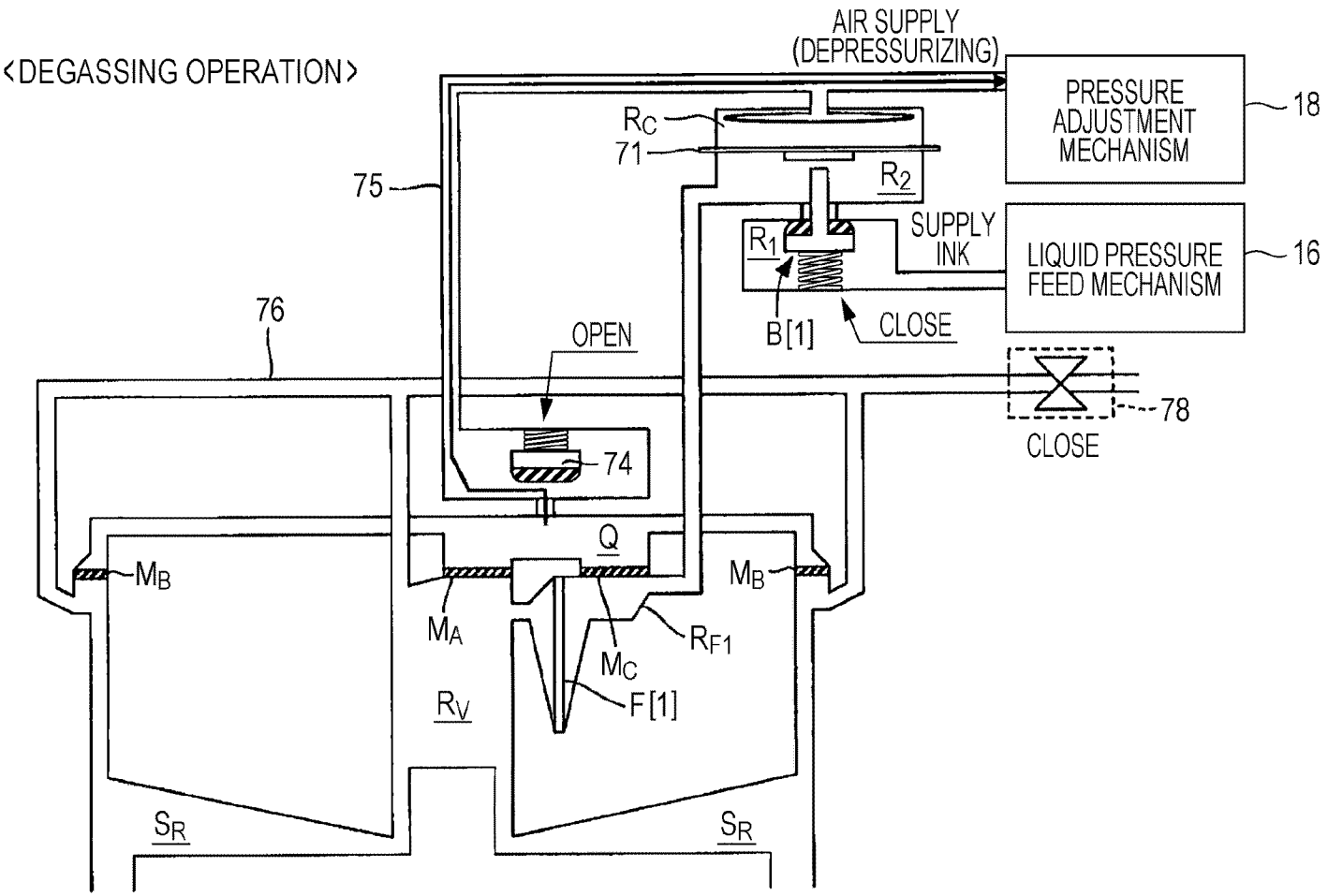
FIG. 20 is an explanatory diagram illustrating a state of the liquid ejecting head at the time of a degassing operation.

In the operating state illustrated in FIG. 19, the air stayed in the degassing space Q is discharged to the outside of the apparatus by the degassing operation. The degassing operation may be executed at any period of time, for example, such as immediately after the power-on of the liquid ejecting apparatus 100, during a period of the printing operation, or the like. FIG. 20 is an explanatory diagram of a degassing operation. As illustrated in FIG. 20, when the degassing operation is started, the pressure adjustment mechanism 18 executes the depressurization operation. In other words, the internal space and the degassing path 75 of the bag-shaped body 73 are depressurized by the suction of air.

When the degassing path 75 is depressurized, the valve body 742 of the check valve 74 is separated from the valve seat 741 against biasing by the spring 743, and the degassing space Q and the degassing path 75 communicate with each other via the communication hole HB. Therefore, the air in the degassing space Q is discharged to the outside of the apparatus via the degassing path 75. On the other hand, although the bag-shaped body 73 contracts by depressurization in the internal space, there is no influence on the pressure in the control chamber $R_C$ (further the movable film 71), and thus the opening/closing valve B[1] is maintained in a state of being closed.

As described above, in the first embodiment, the pressure adjustment mechanism 18 is commonly used in the opening/closing of the opening/closing valve B[1] and the opening/closing of the check valve 74, and thus there is an advantage in that the configuration for controlling the opening/closing valve B[1] and the check valve 74 is simplified, compared to a configuration in which the opening/closing valve B[1] and the check valve 74 are controlled by each individual mechanism.

Figure 21:
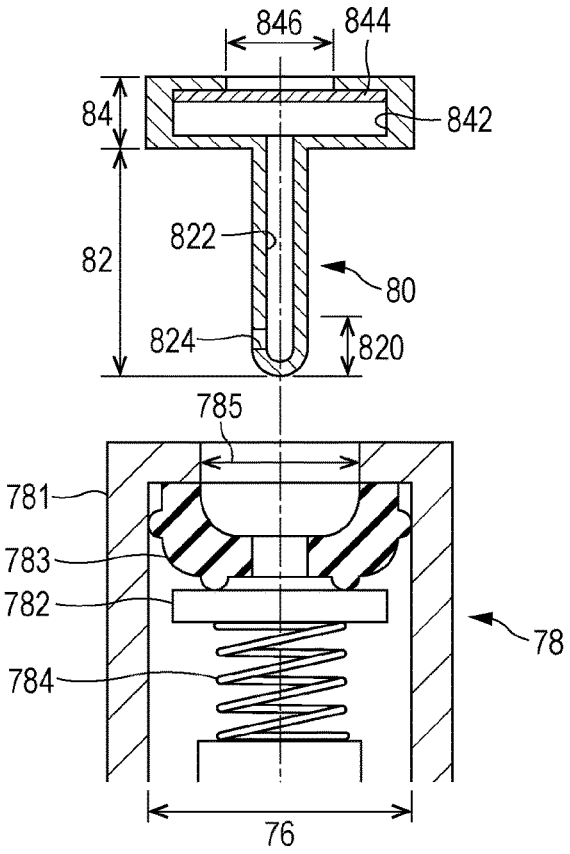
FIG. 21 is a sectional view of a closing valve and an opening valve unit.

The specific configuration of the closing valve 78 in the first embodiment will be described. FIG. 21 is a sectional view illustrating the configuration of the closing valve 78. As illustrated in FIG. 21, the closing valve 78 according to the first embodiment includes a communication tube 781, a moving object 782, a sealing portion 783, and a spring 784. The communication tube 781 is a circular tube body in which an opening portion 785 is formed on the end surface, and accommodates the moving object 782, the sealing portion 783, and the spring 784. The internal space of the communication tube 781 corresponds to the end portion of the discharge path 76.

The sealing portion 783 is a ring-shaped member that is formed with an elastic material such as rubber or the like, and is provided at one end side of the internal space of the communication tube 781 so as to be concentrical with the communication tube 781. The moving object 782 is a member that is movable in the direction of the center axis of the communication tube 781 in the inside of the communication tube 781. As illustrated in FIG. 21, the moving object 782 is brought to close contact with the sealing portion 783 by biasing of the spring 784. The moving object 782 and the sealing portion 783 are brought to close contact with each other, and thus the discharge path 76 inside the communication tube 781 is closed. As described above, since the moving object 782 is biased so as to close the discharge path 76, when normal use of the liquid ejecting apparatus 100 (FIG. 19), it is possible to reduce the possibility that the air bubble is mixed into the ink in the liquid ejecting unit 40 via the discharge path 76, or the possibility that the ink in the liquid ejecting unit 40 is leaked via the discharge path 76. On the other hand, when the moving object 782 is separated from the sealing portion 783 by the action of external force via the opening portion 785 of the communication tube 781, the discharge path 76 inside the communication tube 781 communicates with the outside via the sealing portion 783. In other words, the discharge path 76 is in an opened state (FIG. 18).

In the stage of the initial filling illustrated in FIG. 18, in order to move the moving object 782 of the closing valve 78, a valve opening unit 80 of FIG. 21 is used. The valve opening unit 80 according to the first embodiment includes an insertion portion 82 and a base portion 84. The insertion portion 82 is a needle-shaped portion in which a communication flow path 822 is formed, and an opening portion 824 that communicates with the communication flow path 822 is formed at the tip portion 820 of the insertion portion 82 (opposite side of the base portion 84). The base portion 84 includes a storage space 842 that communicates with the communication flow path 822 of the insertion portion 82, a gas-permeable film 844 that closes the communication flow path 822, and a discharge port 846 that is formed on the opposite side of the communication flow path 822 interposing the gas-permeable film 844.

Figure 22:
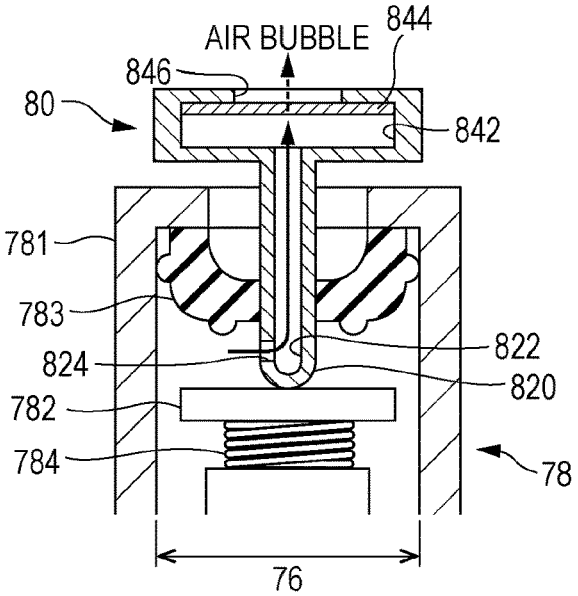
FIG. 22 is an explanatory view illustrating a state where the closing valve is opened using the opening valve unit.

In the stage of the initial filling, as illustrated in FIG. 22, the insertion portion 82 of the valve opening unit 80 is inserted from the opening portion 785 to the communication tube 781. The moving object 782 is moved in a direction away from the sealing portion 783 by the external force applied from the tip portion 820 of the insertion portion 82. When the insertion portion 82 is further inserted, the outer peripheral surface of the insertion portion 82 and the inner peripheral surface of the sealing portion 783 are brought close contact with each other, and thus the insertion portion 82 is in a state of being held by the sealing portion 783. In the above state, the opening portion 824 of the insertion portion 82 is positioned at the discharge path 76 side (moving object 782 side) when viewed from the sealing portion 783. In other words, the portion between the outer peripheral surface of the insertion portion 82 that is at the base portion side when viewed from the opening portion 824 and the inner peripheral surface of the communication tube 781 (inner peripheral surface of the discharge path 76) is sealed by the sealing portion 783. The position of the moving object 782 in the above state is hereinafter referred to as the "opened position". In a state where the moving object 782 is moved to the opened position, the discharge path 76 communicates with the storage space 842 via the opening portion 824 of the tip portion 820 of the valve opening unit 80. As can be understood from the above description, in the first embodiment, it is possible to easily move the moving object 782 to the opened position by the insertion of the valve opening unit 80.

As described above with reference to FIG. 18, when the ink is pressure-fed from the liquid pressure feed mechanism 16, the moving object 782 is moved to the opened position by inserting the valve opening unit 80 into the opening portion 785 of the communication tube 781. Therefore, the air that is present in the internal flow path of the liquid ejecting unit 40 is discharged to the discharge path 76 together with the ink, as illustrated by the arrow in FIG. 22, passes through the opening portion 824 and the communication flow path 822, and reaches the storage space 842 of the valve opening unit 80. The air bubble that reached the storage space 842 passes through the gas-permeable film 844, and is discharged from the discharge port 846 to the outside. As described above, in the first embodiment, the gas-permeable film 844 that closes the communication flow path 822 of the valve opening unit 80 is provided, and thus it is possible to reduce the possibility that the liquid which flows into the communication flow path 822 from the discharge path 76 leaks from the valve opening unit 80.

In the first embodiment, the portion between the outer peripheral surface of the valve opening unit 80 and the inner peripheral surface of the discharge path 76 (the inner peripheral surface of the communication tube 781) is sealed by the sealing portion 783, and thus it is possible to reduce the possibility that the ink leaks via the gap between the outer peripheral surface of the valve opening unit 80 and the inner peripheral surface of the discharge path 76. In addition, in the first embodiment, the sealing portion 783 is commonly used in the sealing between the outer peripheral surface of the valve opening unit 80 and the inner peripheral surface of the discharge path 76, and in the sealing between the moving object 782 and the inner peripheral surface of the discharge path 76. Therefore, there is an advantage in that the structure of the closing valve 78 is simplified, compared to a configuration in which each individual member is used in both sealing.

Second Embodiment

A second embodiment according to the invention will be described. In each configuration to be described below, elements having the same operation or function as that of the first embodiment are denoted by the same reference numerals used in the description of the first embodiment, and the detailed description thereof will not be appropriately repeated.

Figure 23:
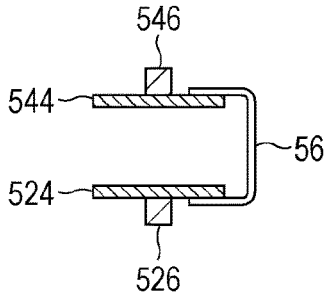
FIG. 23 is an explanatory diagram illustrating the arrangement of a transmission line according to a second embodiment.

FIG. 23 is an explanatory diagram of the arrangement of the transmission line 56 in the second embodiment. In the first embodiment, as described above with reference to FIG. 6, the configuration in which one end of the transmission line 56 is bonded to the surface of the wiring substrate 544 that is opposite to the connection portion 546 and the other end of the transmission line 56 is bonded to the surface of the wiring substrate 524 that is opposite to the connection portion 526 is illustrated. In the second embodiment, as illustrated in FIG. 23, one end of the transmission line 56 is bonded to the surface of the wiring substrate 544 on which the connection portion 546 is provided, and the other end of the transmission line 56 is bonded to the surface of the wiring substrate 524 on which the connection portion 526 is provided. In other words, the transmission line 56 is bent so as to reach the surface of the wiring substrate 524 in the positive Z-direction side from the surface of the wiring substrate 544 in the negative Z-direction side.

As in the first embodiment, in the configuration in which the transmission line 56 is bonded to the surface that is opposite to the connection portion 546 and the surface that is opposite to the connection portion 526, there is a need to form a conduction hole (via hole) for electrically connecting the connection portion 546 and the transmission line 56 on the wiring substrate 544, and form a conduction hole for electrically connecting the connection portion 526 and the transmission line 56 on the wiring substrate 524. In the second embodiment, one end of the transmission line 56 is bonded to the surface of the wiring substrate 544 that is at the connection portion 546 side, and the other end of the transmission line 56 is bonded to the surface of the wiring substrate 524 that is at the connection portion 526 side. Thus, there is an advantage in that there is no need to form the conduction holes on the surface of the wiring substrate 544 and on the surface of the wiring substrate 524.

Third Embodiment

Figure 24:
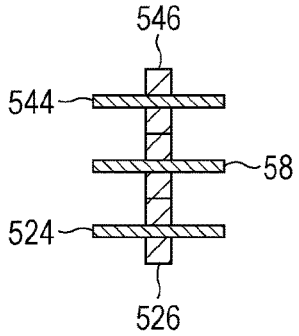
FIG. 24 is a configuration diagram of a coupling unit according to a third embodiment.

FIG. 24 is a partial block diagram of the coupling unit 50 in a third embodiment. In the first embodiment, the connection portion 546 and the liquid ejecting unit 40 are electrically connected to each other by the flexible transmission line 56. In the third embodiment, as illustrated in FIG. 24, the connection portion 546 of the wiring substrate 544 and the connection portion 384 of the liquid ejecting unit 40 are electrically connected to each other by a connection portion 58. The connection portion 58 is a connector (board-to-board connector) having a floating structure, and can absorb the tolerance by the configuration capable of movement to the connection target. Therefore, even in the third embodiment, as in the first embodiment, it is possible to easily assemble or disassemble the liquid ejecting head 24 without considering the stress that is applied from the connection portion 546 to the liquid ejecting unit 40 (further the position deviation of the liquid ejecting unit 40).

As can be understood from the above description, the transmission line 56 in the first embodiment and the second embodiment and the connection portion 58 in the third embodiment are generically expressed as the connector body that is provided between the connection portion 546 and the liquid ejecting unit 40 so as to absorb the error in the position between the connection portion 546 and the liquid ejecting unit 40, and that couples the connection portion 546 and the liquid ejecting unit 40.

Fourth Embodiment

Figure 25:
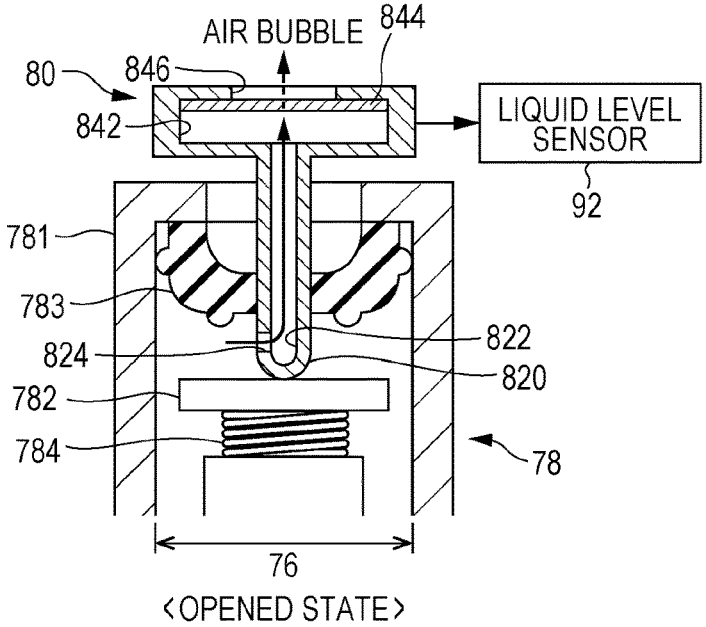
FIG. 25 is a sectional view of an opening/closing valve and an opening valve unit according to a fourth embodiment.

FIG. 25 is a configuration diagram of the closing valve 78 and the valve opening unit 80 in a fourth embodiment. As illustrated in FIG. 25, a liquid level sensor 92 is connected to the valve opening unit 80 according to the fourth embodiment. The liquid level sensor 92 is a detector that detects the liquid level in the communication flow path 822 of the insertion portion 82 of the valve opening unit 80. For example, an optical sensor that radiates light into the communication flow path 822 and receives the light reflected from the liquid level is suitable as the liquid level sensor 92. In the process of the initial filling illustrated in FIG. 18, as the pressure-feed of the ink to the liquid ejecting unit 40 progresses by the liquid pressure feed mechanism 16, there is a tendency that the liquid level in the communication flow path 822 becomes higher.

In the process of the initial filling, the control unit 20 according to the fourth embodiment controls the pressure-feed by the liquid pressure feed mechanism 16 according to the detection result by the liquid level sensor 92. Specifically, in a case where the liquid level detected by the liquid level sensor 92 is lower than a predetermined reference position, the liquid pressure feed mechanism 16 continues the pressure-feed of the ink to the liquid ejecting unit 40. On the other hand, in a case where the liquid level detected by the liquid level sensor 92 is higher than the reference position, the liquid pressure feed mechanism 16 stops the pressure-feed of the ink to the liquid ejecting unit 40.

In the fourth embodiment, the pressure-feed of the ink by the liquid pressure feed mechanism 16 is controlled according to the detection result of the liquid level in the communication flow path 822 by the liquid level sensor 92, and thus it is possible to suppress excessive supply of the ink to the liquid ejecting unit 40.

Fifth Embodiment

In a fifth embodiment, a configuration that controls the operation of the liquid pressure feed mechanism 16 according to the detection result of the liquid level in the communication flow path 822 is illustrated. In the process of the initial filling illustrated in FIG. 18, the control unit 20 according to the fifth embodiment controls the pressure-feed by the liquid pressure feed mechanism 16 according to the detection result of the ink discharged from the nozzles N of the liquid ejecting unit 40. When the ink is excessively supplied to the liquid ejecting unit 40 from the liquid pressure feed mechanism 16, the ink may leak from the nozzles N of the liquid ejecting unit 40 even in a state where the piezoelectric element 484 is not driven. Thus, the liquid pressure feed mechanism 16 according to the fifth embodiment continues the pressure-feed of the ink to the liquid ejecting unit 40 in a case where the leakage of the ink from a particular nozzle N is not detected, and stops the pressure-feed of the ink in a case where the leakage of the ink from the nozzle N is detected. Although a method of detecting the leakage of the ink is arbitrary, for example, a liquid leakage sensor that detects the ink discharged from the nozzles N may be suitably used. When considering a tendency that the characteristics of the residual vibration in the pressure chamber $S_C$ (the vibration remained in the pressure chamber $S_C$ after the displacement of the piezoelectric element 484) are different according to the presence or absence of the leakage of the ink from the nozzles N, it is also possible to detect the leakage of the ink by analyzing the residual vibration.

In the fifth embodiment, the pressure-feed of the ink by the liquid pressure feed mechanism 16 is controlled according to the detection result of the ink discharged from the nozzles of the liquid ejecting unit 40, and thus it is possible to suppress excessive supply of the ink to the liquid ejecting unit 40.

Modification Example

Each embodiment described above may be variously modified. The specific modification forms will be described below. Two or more forms that are arbitrarily selected from the following examples may be appropriately combined with each other within a range in which the forms are not inconsistent with each other.

(1) It is also possible to discharge the air bubble from the nozzles N by sucking the ink of the internal flow path of the liquid ejecting head 24 from the nozzles N side, in addition to the discharge of the air bubble via the degassing path 75 and the discharge path 76. More specifically, the air bubble is discharged from the nozzles N together with the ink by sealing the ejecting face J with a cap and depressurizing the space between the ejecting face J and the cap. The discharge via the degassing path 75 and the discharge path 76 illustrated in each embodiment described above is effective for the air bubble that is present in the internal flow path of the flow path structure which is configured with the valve mechanism unit 41, the flow path unit 42, and the housing portion 485 of the liquid ejecting portion 44. The discharge by the suction from the nozzles N side is effective for the air bubble that is present in the flow path of the liquid ejecting portion 44 from the branch flow path 481B to the nozzles N.

(2) In each embodiment described above, although the configuration in which the ejecting face J includes the first portion $P_1$, the second portion $P_2$, and the third portion $P_3$ is illustrated, one of the second portion $P_2$ and the third portion $P_3$ may be omitted. In each embodiment described above, although the configuration in which the second portion $P_2$ is positioned at the opposite side of the third portion $P_3$ interposing the center line y is illustrated, the second portion $P_2$ and the third portion $P_3$ may be positioned at the same side with respect to the center line y.

(3) The shape of the beam-shaped portion 62 (or the shape of the opening portion 60) in the first support body 242 is not limited to the shape illustrated in each embodiment described above. For example, in each embodiment described above, although the beam-shaped portion 62 having the shape in which the first support portion 621, the second support portion 622, and the intermediate portion 623 are coupled with each other is illustrated, the beam-shaped portion 62 having the shape in which the intermediate portion 623 is omitted (shape in which the first support portion 621 and the second support portion 622 are separated from each other) may be formed in the first support body 242.

(4) In each embodiment described above, although the serial-type liquid ejecting apparatus 100 in which the transport body 262 equipped with the liquid ejecting head 24 is moved in the X-direction is illustrated, the invention may be applied to the line-type liquid ejecting apparatus in which the plurality of nozzles N of the liquid ejecting head 24 are distributed over the entire width of the medium 12. In the line-type liquid ejecting apparatus, the movement mechanism 26 illustrated in each embodiment described above may be omitted.

(5) The element that applies pressure to the inside of the pressure chamber $S_C$ (driving element) is not limited to the piezoelectric element 484 illustrated in each embodiment described above. For example, a heating element that changes pressure by generating air bubbles to the inside of the pressure chamber $S_C$ by heating may be used as the driving element. As can be understood from the above description, the driving element is generically expressed as the element for ejecting liquid (typically, the element that applies pressure to the inside of the pressure chamber $S_C$), and the operating type (piezoelectric type/heating type) and the specific configuration do not matter.

(6) In each embodiment described above, although the connection portions (328, 384, 526, 546) used for electrical connection are illustrated, the invention may be applied to the connection portion for connecting the flow paths through which liquid such as ink or the like circulates. In other words, the connector body according to the invention includes an element that connects the flow path of the first connection portion and the flow path of the liquid ejecting unit (for example, a tube that is formed with an elastic material), in addition to the element that electrically connects the first connection portion and the liquid ejecting unit (for example, the transmission line 56).

Sixth Embodiment

A sixth embodiment according to the invention will be described. The same members as those of the embodiments described above are denoted by the same reference numerals and the description thereof will not be repeated.

Figure 26:
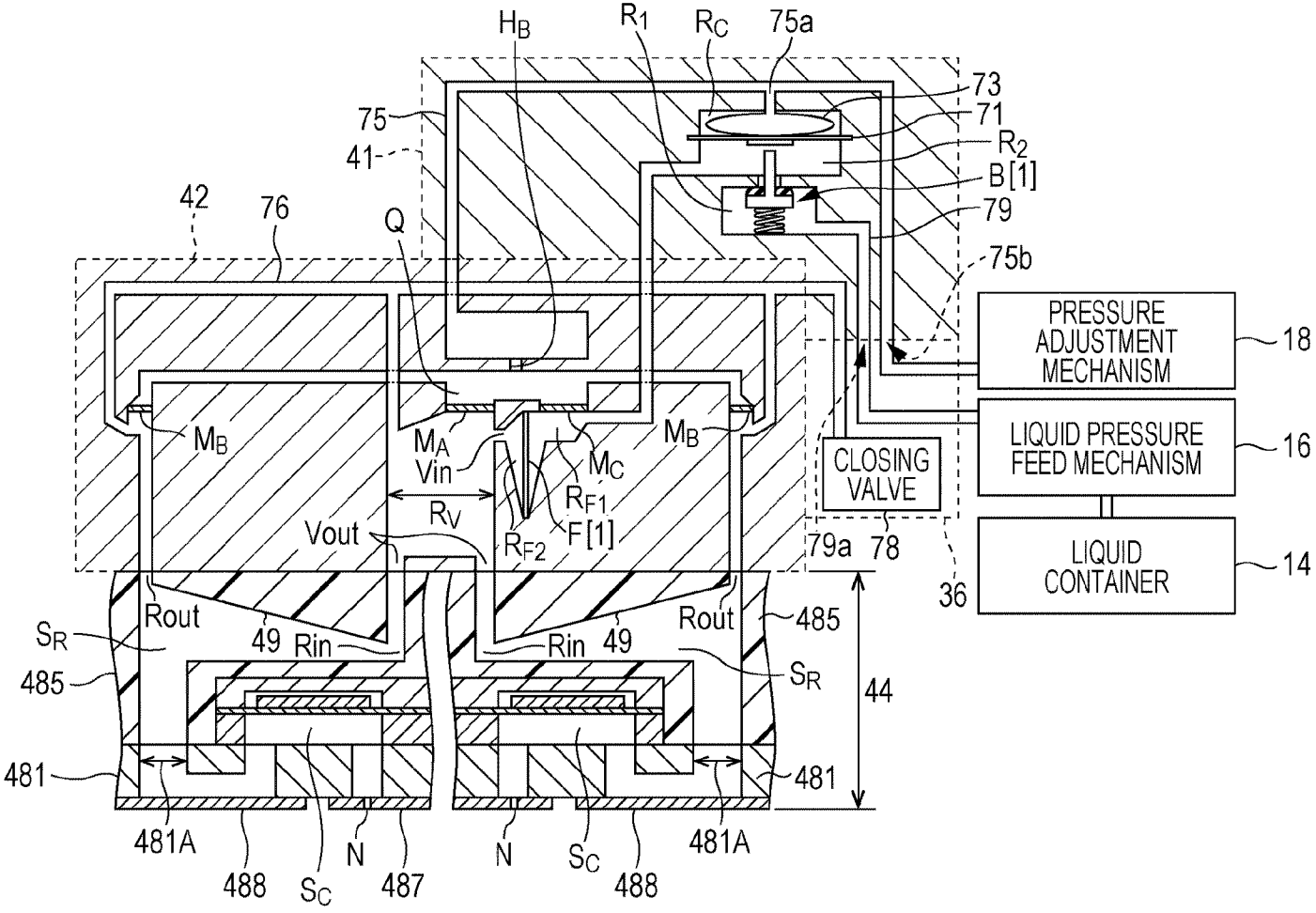
FIG. 26 is an explanatory diagram illustrating the internal flow path of a liquid ejecting unit according to a sixth embodiment.

FIG. 26 is an explanatory diagram of the internal flow path of the flow path unit according to the sixth embodiment. As illustrated in FIG. 26, in the flow path unit 42 according to the sixth embodiment, the check valve 74 according to the first embodiment is not provided between the degassing space Q and the degassing path 75. In other words, the degassing space Q and the degassing path 75 communicate with each other via the communication hole HB.

Further, similarly to the first embodiment, the degassing path 75 is branched in the middle, and commonly communicates with the inside of the bag-shaped body 73 provided in the control chamber $R_C$ and the degassing space Q. In other words, a branch point 75*a* at which the degassing path 75 is branched is provided in the degassing path 75. The branch point 75*a* and the inside of the bag-shaped body 73 provided in the control chamber $R_C$ are provided so as to communicate with each other, and the branch point 75*a* and the degassing space Q are provided so as to communicate with each other. In the present embodiment, the inside of the bag-shaped body 73 that communicates with the branch point 75*a* corresponds to a first chamber, and the degassing space Q corresponds to a second chamber.

The branch point 75*a* of the degassing path 75 is connected to the pressure adjustment mechanism 18 via the distribution flow path 36 that is connected to a second connection port 75*b*. In other words, the pressure adjustment mechanism 18 is connected to the second connection port 75*b* via the distribution flow path 36, the second connection port 75*b* being a connection port of one flow path before the degassing path 75 is branched into two.

As described above, the pressure adjustment mechanism 18 can select the pressurization operation (pressurization mode) and the depressurization operation (depressurization mode) according to the instruction from the control unit 20 as a control unit, the pressurization operation for supplying the second fluid such as air or the like to the degassing path 75 which is connected to the pressure adjustment mechanism 18, and the depressurization operation for depressurizing by the suction of the second fluid such as air or the like from the degassing path 75.

The internal space of the bag-shaped body 73 as a first chamber and the degassing path 75 are pressurized by the pressurization operation of the pressure adjustment mechanism 18. Therefore, the bag-shaped body 73 in the control chamber $R_C$ expands, and thus the bag-shaped body 73 presses the movable film 71. As a result, the valve body 722 is moved, and thus the space $R_1$ and the space $R_2$ communicate with each other. At this time, the check valve 74 according to the first embodiment is not provided between the degassing space Q and the degassing path 75, and thus the degassing space Q is also pressurized at the same time. However, the gas-permeable films $M_A$ and $M_B$ are provided between the degassing space Q and the vertical space $R_V$ and between the degassing space Q and the space $R_{F1}$, and only the gas that passed through the gas-permeable films $M_A$ and $M_B$ is held in the degassing space Q, the vertical space $R_V$ and the space $R_{F1}$ being the flow path of the ink. The pressurization operation of the pressure adjustment mechanism 18 is performed in a shorter time than the depressurization operation. For this reason, when the pressurization of the internal space of the bag-shaped body 73 as the first chamber is performed, even though the gas in the degassing space Q as the second chamber is pressurized, the gas of the second chamber is difficult to pass through the gas-permeable films $M_A$ and $M_B$. Thus, the gas of the second chamber is difficult to enter into the vertical space $R_V$ and the space $R_{F1}$ that are the flow paths of the ink.

The degassing space Q as the second chamber is depressurized by the depressurization operation of the pressure adjustment mechanism 18. As a result, the gas that is held in the degassing space Q is discharged via the degassing path 75. The second fluid in the first chamber is also depressurized by the depressurization operation of the pressure adjustment mechanism 18, and thus the bag-shaped body 73 contracts, that is, the volume of the bag-shaped body 73 contracts. Even though the bag-shaped body 73 contracts, there is no influence on the pressure in the control chamber $R_C$, and thus the opening/closing valve B[1] is maintained in the closed state. The control chamber $R_C$ is opened to the atmosphere although not particularly illustrated, and thus, the state of the bag-shaped body 73, that is, the pressure in the control chamber $R_C$ by the expansion or the contraction does not change. In other words, the control chamber $R_C$ becomes a buffer chamber that does not communicate with the internal space of the bag-shaped body 73 as the first chamber and the degassing space Q as the second chamber. In a case where the control chamber $R_C$ as the buffer chamber is not provided, it is possible to suppress a change in the characteristics of the opening/closing valve B[1] without influencing the movable film 71 by the contraction of the bag-shaped body 73. Further, by the simple configuration in which the control chamber $R_C$ is opened to the atmosphere, it is possible to suppress a change in the characteristics of the opening/closing valve B[1] by the contraction of the bag-shaped body 73. Thus, a complicated configuration is not necessary, and it is possible to reduce the cost.

On the other hand, the flow path 79 to which the ink as the first fluid is supplied is connected to the liquid pressure feed mechanism 16 via the distribution flow path 36 connected to the first connection port 79*a*. In other words, the ink that is pressure-fed from the liquid pressure feed mechanism 16 via the first connection port 79*a* is supplied to the vertical space $R_V$ via the opening/closing valve B[1] in the opened state, and supplied to the common liquid chamber $S_R$ and each pressure chamber $S_C$ from the vertical space $R_V$.

In this way, the pressurization of the internal space of the bag-shaped body 73 as the first chamber and the depressurization of the degassing space Q as the second chamber are performed by the single pressure adjustment mechanism 18 connected to the second connection port 75*b*. Therefore, when the liquid ejecting unit 40 is attached and detached, it is possible to easily attach and detach the liquid ejecting unit 40 only by connecting the liquid pressure feed mechanism 16 to the first connection port 79*a* for circulating the ink as the first fluid, and connecting the pressure adjustment mechanism 18 to the second connection port 75*b* for circulating the second fluid. In other words, only by connecting two of the first connection port 79*a* and the second connection port 75*b*, it is possible to attach and detach the liquid ejecting unit 40, thereby simplifying the attaching and detaching operations. In a case where the connection port to which a pressurization unit that pressurizes the first chamber is connected and the connection port to which a depressurization unit that depressurizes the second chamber is connected are individually provided, the connection of the total of three connection ports including the first connection port 79*a* should be performed, and thus the operation of attaching and detaching the connection ports becomes complicated. Further, in a case where the connection port for pressurization and the connection port for depressurization are individually provided, the pressurization unit such as a pressurization pump or the like and the depressurization unit such as a depressurization pump or the like should be provided for each connection port, and thus the cost becomes higher. In the present embodiment, the pressurization and the depressurization can be performed by the common second connection port 75*b*. Thus, it is possible to reduce the cost by only providing one pressure adjustment mechanism 18 that performs both of the pressurization and the depressurization.

In the present embodiment, although air as the second fluid is illustrated, the second fluid is not particularly limited thereto. As the second fluid, inert gas, liquid used for ink, liquid other than ink, or the like may be used. In the other embodiment in this specification are also similar.

In the present embodiment, although the opening/closing valve B[1] is opened by pressurizing the first chamber and expanding the bag-shaped body 73, the use of pressurizing the first chamber is particularly not limited thereto. For example, a so-called pressurization wiping that pressurizes the ink in the flow path by pressurizing the first chamber and wipes the ejecting face while the ink exudes from the nozzles N may be performed. In addition, by changing the volume of the damper chamber for absorbing the pressure variation in the flow path due to the pressurization of the first chamber, the characteristics of the damper chamber may be changed. In other words, the pressurization of the first chamber may be used for the purpose of changing the volume of the flow path through which the ink passes. Of course, the first chamber may also be used for another use other than for changing the volume of the flow path through which the ink passes. As another use, for example, the first chamber may be used to blow away the dust attached to the vicinity of the nozzles N by the second fluid, by opening the first chamber so as to face the nozzles N and blowing the second fluid from the opening using the pressurization of the first chamber.

Although the air bubble in the degassing space Q as the second chamber is removed by depressurizing the second chamber, the use of depressurizing the second chamber is particularly not limited thereto. For example, the second chamber may be used to collect the ink in the flow path together with the air bubble, by communicating with the flow path through which the ink passes via a one-way valve and opening the one-way valve at the time of depressurizing the second chamber. In other words, the second chamber may be used for the purpose of collecting the air bubble included in the ink. Of course, the second chamber may also be used for another use other than the purpose of collecting the air bubble included in the ink. As another use, for example, by changing the volume of the damper chamber for absorbing the pressure variation in the flow path due to the pressurization of the second chamber, the characteristics of the damper chamber may be changed. Furthermore, the second chamber may be used to remove the dust attached to the vicinity of the nozzles N by suction, by opening the second chamber so as to face the nozzles N and depressurizing the second chamber.

Further, the portion at which the first chamber and the movable film 71 are in contact with each other, that is, the portion at which the bag-shaped body 73 that includes the first chamber therein and the movable film 71 are in contact with each other, is preferably roughened. The portion at which the bag-shaped body 73 and the movable film 71 are in contact with each other being roughened means that at least one of the portion at which the bag-shaped body 73 is in contact with the movable film 71 and the portion at which the movable film 71 is in contact with the bag-shaped body 73 is roughened. Being roughened means that, for example, the abutting surface obtained by dry etching, blasting, wet etching, or the like is processed to have a rough surface or a film having a rough surface is formed. In this way, the portion at which the bag-shaped body 73 and the movable film 71 are in contact with each other is roughened, and thus it is possible to prevent the bag-shaped body 73 and the movable film 71 from sticking together by condensation or the like.

Seventh Embodiment

A seventh embodiment according to the invention will be described. The same members as those of the embodiments described above are denoted by the same reference numerals and the description thereof will not be repeated.

Figure 27:
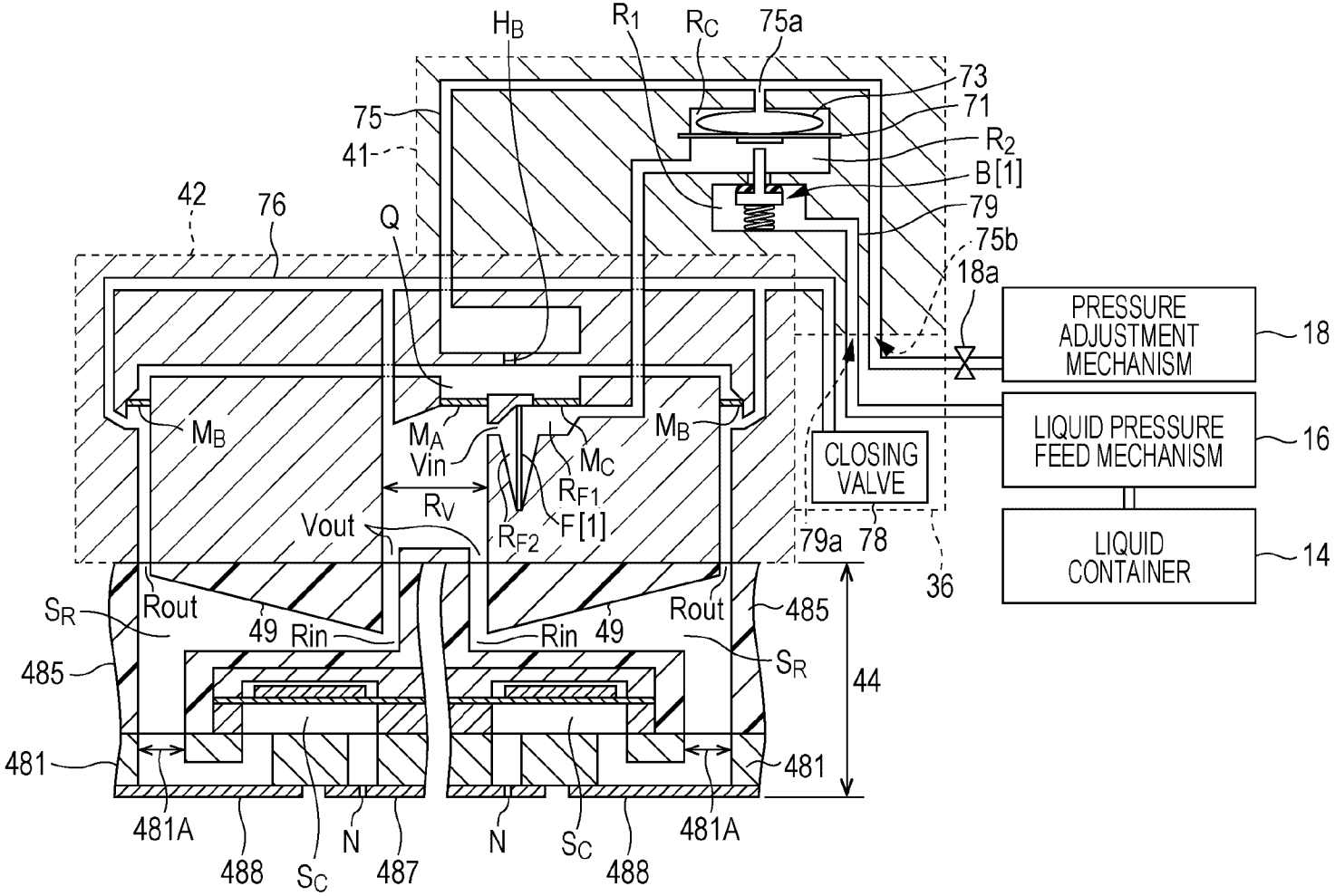
FIG. 27 is an explanatory diagram illustrating the internal flow path of a liquid ejecting unit according to a seventh embodiment.

FIG. 27 is an explanatory diagram of the internal flow path of the flow path unit according to the seventh embodiment. As illustrated in FIG. 27, a bidirectional valve 18*a* is connected to the side of the second connection port 75*b* that is opposite to the branch point 75*a*, as a depressurization maintaining unit. In other words, the bidirectional valve 18*a* is provided between the second connection port 75*b* and the pressure adjustment mechanism 18.

The bidirectional valve 18*a* is made of, for example, an electromagnetic valve or the like, and controlled so as to close the flow path at a predetermined timing by the control unit 20. Here, the timing at which the flow path is closed by the bidirectional valve 18*a* is a timing after the depressurization operation is performed by the pressure adjustment mechanism 18. In other words, the flow path is closed by the bidirectional valve 18*a* after the depressurization operation is performed by the pressure adjustment mechanism 18, and thus the depressurization state of the degassing path 75 and the degassing space Q is maintained.

In this way, even though the pressure adjustment mechanism 18 is not continuously driven, it is possible to maintain the depressurization state of the degassing space Q and the degassing path 75 by providing the bidirectional valve 18*a*. The depressurization state of the degassing space Q is maintained. Thus, the air bubble in the space $R_{F1}$ is discharged to the degassing space Q via the gas-permeable film $M_C$, and the air bubble in the vertical space $R_V$ is discharged to the degassing space Q via the gas-permeable film $M_A$. After the depressurization state is maintained, the depressurization by the pressure adjustment mechanism 18 is performed and the bidirectional valve 18*a* is opened at a predetermined timing. Thus, the air bubble discharged to the degassing space Q is discharged to the outside from the second connection port 75*b* via the degassing path 75, that is, to the outside from the bidirectional valve 18*a* which is connected to the second connection port 75*b* and the pressure adjustment mechanism 18.

As described above, the depressurization maintaining unit that includes the bidirectional valve 18*a* and the pressure adjustment mechanism 18 is provided, and thus the depressurization state of the degassing space Q is maintained. Therefore, degassing of the air bubble included in the ink to the degassing space Q can be reliably performed over a long period of time. Further, since the depressurization state of the degassing space Q is maintained, there is no need to drive the pressure adjustment mechanism 18 all the time, and thus it is possible to reduce the power consumption.

In the present embodiment, the bidirectional valve 18*a* is connected to the second connection port 75*b*, that is, the bidirectional valve 18*a* is provided at the outside of the liquid ejecting unit 40, and thus it is possible to reduce the size of the liquid ejecting unit 40. The position at which the bidirectional valve 18*a* is provided is not particularly limited thereto. For example, the bidirectional valve 18*a* may be provided at the distribution flow path 36, and the bidirectional valve 18*a* may be provided at the valve mechanism unit 41, the flow path unit 42, or the like.

In the present embodiment, although the bidirectional valve 18*a* and the pressure adjustment mechanism 18 are provided as the depressurization maintaining unit, the depressurization maintaining unit is not particularly limited thereto. For example, the depressurization state of the degassing space Q as the second chamber may be maintained by constantly or intermittently driving the pressure adjustment mechanism 18 without providing the bidirectional valve 18*a*. In addition, similar to the first embodiment, the depressurization state of the degassing space Q as the second chamber may be maintained by providing the check valve 74 that is an one-way valve which allows only the flow from the degassing space Q to the degassing path 75 between the degassing space Q and the degassing path 75, and using the check valve 74. Here, as described above, the check valve 74 illustrated in FIGS. 15 and 16 is a valve mechanism that allows the circulation of air directed to the degassing path 75 from the degassing space Q, on the one hand, and inhibits the circulation of air directed to the degassing space Q from the degassing path 75. Thus, since the check valve 74 is provided, the degassing space Q is depressurized by the pressure adjustment mechanism 18, and the depressurization state of the degassing space Q is maintained by the check valve 74 even when the depressurization operation by the pressure adjustment mechanism 18 is stopped.

Eighth Embodiment

An eighth embodiment according to the invention will be described. The same members as those of the embodiments described above are denoted by the same reference numerals and the description thereof will not be repeated.

Figure 28:
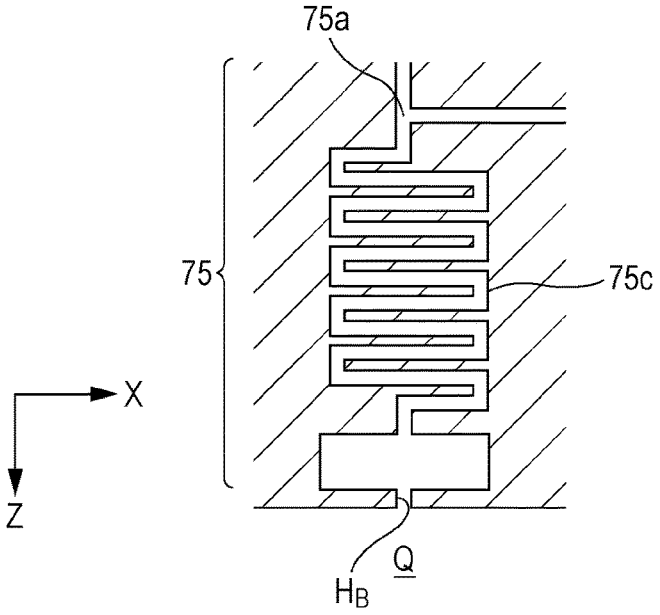
FIG. 28 is an explanatory diagram illustrating the degassing path of a liquid ejecting unit according to an eighth embodiment.

FIG. 28 is an explanatory diagram of the degassing path of the flow path unit according to the eighth embodiment. As illustrated in FIG. 28, in the degassing path 75, the degassing path 75 between the branch point 75*a* and the degassing space Q as the second chamber is configured by a zigzag path 75*c* that reciprocates in the X-direction and zigzags toward the Z-direction. In this way, the zigzag path 75*c* is provided, and thus diffusion resistance is applied to the degassing path 75. Therefore, it is possible to suppress the evaporation of the ink from the gas-permeable films $M_A$ and $M_B$. Since the moisture of the ink in the flow path passes through the gas-permeable films $M_A$ and $M_B$, when the zigzag path 75*c* is not provided, the moisture of the ink is likely to evaporate, and thus there is a problem such as an increase in the viscosity of the ink or the like. In the present embodiment, the zigzag path 75*c* is provided, and thus it is possible to suppress the evaporation of the moisture of the ink that passes through the gas-permeable films $M_A$ and $M_B$. Therefore, the problem such as the increase in the viscosity of the ink or the like can be prevented.

In the present embodiment, the zigzag path 75*c* is provided at the degassing path 75 between the branch point 75*a* and the degassing space Q as the second chamber. Thus, it is possible to perform the pressurization operation and the depressurization operation by the pressure adjustment mechanism 18 at a low pressure, compared to a configuration in which the entire degassing path 75 is configured by the zigzag path 75*c*. In other words, when all of the degassing path 75 is configured by the zigzag path 75*c*, since the path length of the degassing path 75 becomes longer, there is a need to perform the pressurization operation and the depressurization operation by the pressure adjustment mechanism 18 at a high pressure, or drive the pressure adjustment mechanism 18 at a low pressure over a long period of time. In order to output such a high pressure, the size and the cost of the pressure adjustment mechanism 18 increases. In a case where the pressure adjustment mechanism 18 is driven at a low pressure over a long period of time, since it takes some time for the pressurization operation and the depressurization operation, there is a problem that the print waiting time becomes longer or the like. In the present embodiment, only the degassing path 75 between the branch point 75*a* and the degassing space Q as the second chamber is configured by the zigzag path 75*c*, and thus it is possible to perform the pressurization operation and the depressurization operation by the pressure adjustment mechanism 18 at a low pressure in a short period of time. Therefore, it is possible to suppress the increase in size and cost and shorten the print waiting time by shortening the time for the pressurization operation and the depressurization operation. Of course, the degassing path 75 between the branch point 75*a* and the second connection port 75*b* may be configured by the zigzag path, and all of the degassing path 75 may be configured by the zigzag path.

Ninth Embodiment

A ninth embodiment according to the invention will be described. The same members as those of the embodiments described above are denoted by the same reference numerals and the description thereof will not be repeated.

Figure 29:
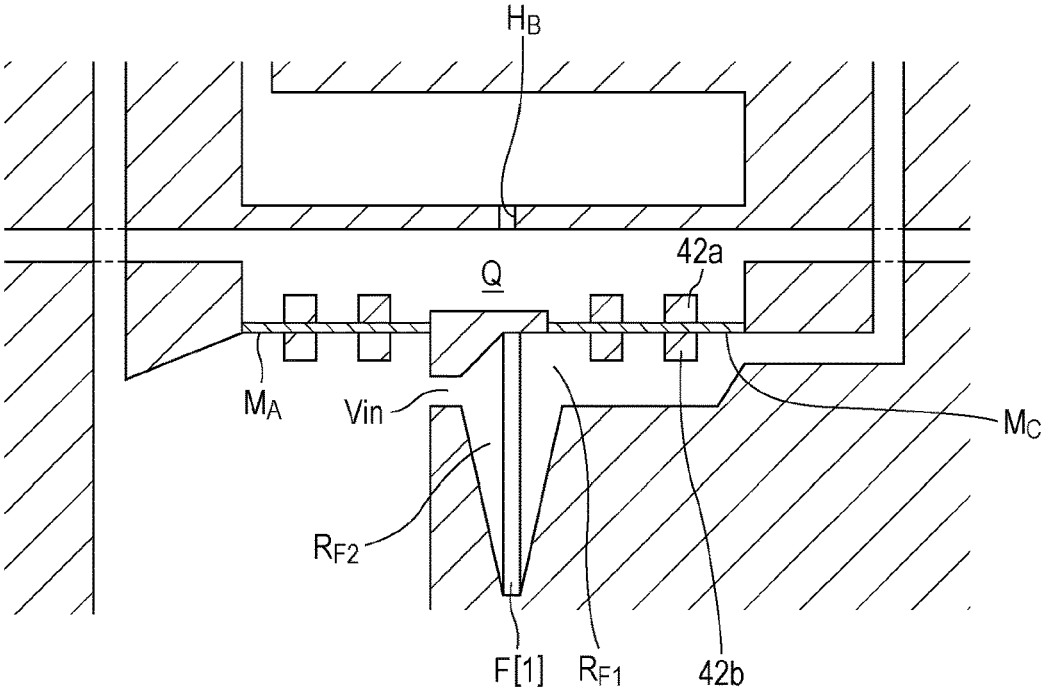
FIG. 29 is a diagram illustrating a main portion of a flow path unit according to a ninth embodiment.

FIG. 29 is a diagram illustrating a main portion of the flow path unit according to the ninth embodiment. As illustrated in FIG. 29, a plurality of beam-shaped first regulating portions 42*a* are provided on the sides of the gas-permeable films $M_A$ and $M_C$ that are on the degassing space Q side. In addition, a plurality of beam-shaped second regulating portions 42*b* are provided on the sides of the gas-permeable films $M_A$ and $M_C$ that are on the vertical space $R_V$ side and the space $R_{F1}$ side. The first regulating portions 42*a* and the second regulating portions 42*b* are integrally provided with the walls forming each space.

In this way, the first regulating portions 42*a* are provided, and thus, when the degassing space Q as the second chamber is depressurized, the deformation of the gas-permeable films $M_A$ and $M_C$ to the degassing space Q side is regulated. Therefore, it is possible to suppress the decrease of the volume of the degassing space Q.

In addition, the second regulating portions 42*b* are provided, and thus, when the degassing space Q as the second chamber is pressurized, the deformation of the gas-permeable films $M_A$ and $M_C$ to the side that is opposite to the degassing space Q is regulated. Therefore, it is possible to suppress an increase in the volume of the degassing space Q.

In other words, the plurality of beam-shaped first regulating portions 42*a* and the plurality of beam-shaped second regulating portions 42*b* are provided, and thus the deformation of the gas-permeable films $M_A$ and $M_C$ is regulated by the first regulating portions 42*a* and the second regulating portions 42*b*, without inhibiting the gas from passing through the gas-permeable films $M_A$ and $M_C$ by the first regulating portions 42*a* and the second regulating portions 42*b*. Therefore, it is possible to prevent the gas-permeable films $M_A$ and $M_C$ from being damaged due to the deformation of the gas-permeable films $M_A$ and $M_C$.

The first regulating portions 42*a* and the second regulating portions 42*b* are not limited to those described above, as long as the first regulating portions 42*a* and the second regulating portions 42*b* can suppress the expansion and the contraction of the degassing space Q as the second chamber. The first regulating portions 42*a* and the second regulating portions 42*b* may be one in which a plurality of beam-shaped regulating portions are combined with each other in a grid shape, that is, one in which a plurality of beam-shaped regulating portions are provided in a mesh shape. The first regulating portions 42*a* and the second regulating portions 42*b* may be convex portions or the like protruding from the wall surfaces that faces the gas-permeable films $M_A$ and $M_C$.

Tenth Embodiment

A tenth embodiment according to the invention will be described. The same members as those of the embodiments described above are denoted by the same reference numerals and the description thereof will not be repeated.

Figure 30:
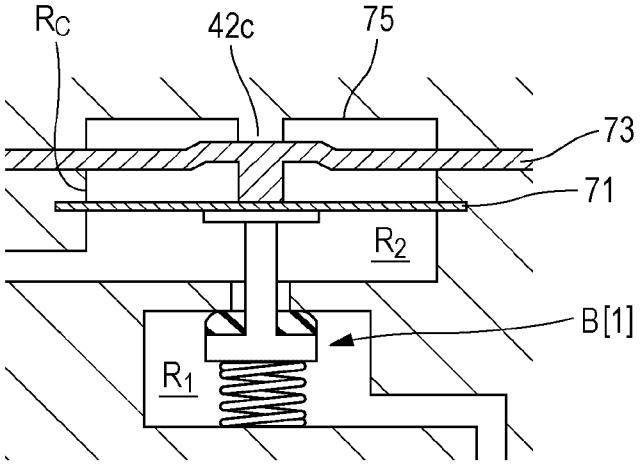
FIG. 30 is a diagram illustrating a main portion of a flow path unit according to a tenth embodiment.

FIG. 30 is a diagram illustrating a main portion of the flow path unit according to the tenth embodiment. As illustrated in FIG. 30, the bag-shaped body 73 is provided closing the opening of the control chamber $R_C$. In the present embodiment, the bag-shaped body 73 is intended to elastically deform to the movable film 71 side in a bag shape when the degassing path 75 is pressurized by the pressurization operation of the pressure adjustment mechanism 18, and to have a plate shape when the pressurization operation is not performed. In other words, the bag-shaped body 73 as a plate-shaped member is deformed in a bag shape in the control chamber $R_C$ by the pressurization of the degassing path 75.

A third regulating portion 42*c* protruding toward the bag-shaped body 73 is provided on the surface of the degassing path 75 that faces the bag-shaped body 73. The third regulating portion 42*c* is provided, and thus, when the degassing path 75 is depressurized, it is possible to regulate the deformation of the bag-shaped body 73 to the side that is opposite to the movable film 71. As described above, in a case where the bag-shaped body 73 is deformed in a bag shape, although the first chamber is the internal space of the bag-shaped body 73, since the bag-shaped body 73 has a plate shape in a normal use, the first chamber becomes the degassing path 75. When the degassing path 75 is depressurized, the third regulating portion 42*c* regulates the decrease of the volume of the degassing path 75 as the first chamber.

In this way, since the third regulating portion 42*c* is provided on the side of the bag-shaped body 73 that is opposite to the movable film 71, the third regulating portion 42*c* does not inhibit the bag-shaped body 73 from being deformed during pressurization, and the third regulating portion 42*c* regulates the deformation of the bag-shaped body 73 during depressurization. Therefore, it is possible to prevent the bag-shaped body 73 from being damaged due to the deformation of the bag-shaped body 73. As in the first regulating portion 42*a* and the second regulating portion 42*b*, the third regulating portion 42*c* may be one in which regulating portions are provided in a beam shape.

As described above, in a case where the first chamber is used in order to open the opening/closing valve B[1] by the pressurization to the first chamber, perform a so-called pressure wiping, or change the characteristics of the damper chamber, at least a portion of the first chamber is preferably formed by a flexible member such as rubber, elastomer, or the like. In a case where a flexible member is used for a portion of the first chamber, the other portion of the first chamber may be formed by a thermosetting resin, metal, or the like. In a case where the first chamber is used in order to blow away the dust attached to the vicinity of the nozzles N by the second fluid using the pressurization to the first chamber, the first chamber is preferably formed by a thermosetting resin, metal, or the like.

In a case where the second chamber is used in order to remove the air bubble in the degassing space Q by the depressurization of the second chamber, at least a portion of the second chamber is preferably formed by a sheet-shaped gas-permeable member (for example, a thin film of polyacetal, polypropylene, polyphenylene ether, or the like), or a rigid wall having a thickness enough to exhibit gas permeability (for example, a rigid wall obtained by forming the flow path unit 42 including gas-permeable partitions with a plastic material such as POM (polyacetal), m-PPE (modified polyphenylene ether), PP (polypropylene), or the like, or alloys of these materials, and typically making the thickness of the rigid wall to approximately 0.5 mm). Alternatively, in a case where the room that communicates with the room formed by the sheet-shaped member or the rigid wall via a valve corresponds to the second chamber, the second chamber may be formed by a thermosetting resin, metal, or the like. In a case where the second chamber is used in order to remove the dust attached to the vicinity of the nozzles N by suction using the depressurization to the second chamber, the second chamber is preferably formed by a thermosetting resin, metal, or the like. That is, it is preferable that at least a portion of the first chamber and at least a portion of the second chamber are formed by a different member.

As described above, in a case where the first chamber is used in order to open the opening/closing valve B[1] by the pressurization to the first chamber, perform a so-called pressure wiping, or change the characteristics of the damper chamber, the first chamber is preferably adjacent to the flow path of the first fluid. In a case where the first chamber is used in order to blow away the dust attached to the vicinity of the nozzles N by the second fluid using the pressurization to the first chamber, the first chamber may not be adjacent to the flow path of the first fluid. Hereupon if changing a pressure in the first chamber results in changing a pressure in the flow path of the first fluid, both of them may be alleged to be adjacent to each other. When both of them are adjacent to each other, it is possible to transmit effectively the pressure change in the first chamber through the flow path of the first fluid.

In a case where the second chamber is used in order to remove the air bubble in the degassing space Q by the depressurization of the second chamber, the second chamber is preferably adjacent to the flow path of the first fluid. In a case where the second chamber is used in order to remove the dust attached to the vicinity of the nozzles N by suction using the depressurization to the second chamber, the second chamber may not be adjacent to the flow path of the first fluid. Hereupon if changing a pressure in the second chamber results in changing a pressure in the flow path of the first fluid, both of them may be alleged to be adjacent to each other. When both of them are adjacent to each other, it is possible to transmit effectively the pressure change in the second chamber through the flow path of the first fluid.

What is claimed is:

1. An ejecting unit for ejecting a first fluid from nozzles, comprising:

a first connection port to flow the first fluid;

a second connection port to flow a second fluid;

a driving portion configured to eject the first fluid in a flow path which communicates with the first connection port and the nozzles, from the nozzles;

a first chamber that communicates with the second connection port; and a second chamber that communicates with the second connection port, wherein the first and second chambers are configured to be connected with a pressure adjustment mechanism at a same time by the second connection port.

2. The ejecting unit according to claim 1, wherein the first chamber is configured to change the volume of the flow path, and wherein the second chamber is configured to store an air in the flow path.

3. The ejecting unit according to claim 1, further comprising:

a film that is biased to the first chamber by pressurization to the first chamber; and a buffer chamber that is provided between the first chamber and the film and does not communicate with the first chamber and the second chamber in the ejecting unit.

4. The ejecting unit according to claim 3, wherein the buffer chamber is opened to the atmosphere.

5. The ejecting unit according to claim 3, wherein a portion at which the first chamber and the film are in contact with each other is roughened.

6. The ejecting unit according to claim 1, further comprising:

a gas-permeable film that is disposed between the second chamber and the flow path; and a zigzag path that applies diffusion resistance between the second chamber and the second connection port, wherein the air in the flow path is moved to the inside of the second chamber by depressurizing the inside of the second chamber.

7. The ejecting unit according to claim 1, further comprising:

a gas-permeable film that is provided between the second chamber and the flow path; and a depressurization maintaining unit in communication with the second connection port.

8. The ejecting unit according to claim 1, further comprising:

a one-way valve that is provided between the second chamber and the second connection port.

9. The ejecting unit according to claim 1, further comprising:

at least one regulating portion that regulates the expansion and the contraction of the volume of the second chamber.

10. The ejecting unit according to claim 1, further comprising:

a regulating portion that regulates the contraction of the volume of the first chamber.

11. The ejecting unit according to claim 1, wherein at least a portion of the first chamber and at least a portion of the second chamber are formed by a different member.

12. The ejecting unit according to claim 1, wherein any one of the first chamber and the second chamber is adjacent to the flow path of the first fluid, and wherein the other of the first chamber and the second chamber is not adjacent to the flow path of the first fluid.

13. An ejecting apparatus, comprising:

the ejecting unit according to claim 1; and a pressure adjuster configured to pressurize the first chamber via the second connection port and depressurize the second chamber via the second connection port.

* * * * *